US011297875B2

(12) United States Patent
Gammerler et al.

(10) Patent No.: US 11,297,875 B2
(45) Date of Patent: Apr. 12, 2022

(54) CONSISTENT RADIANT HEATING SYSTEM FOR VAPORIZING TOBACCO AND METHOD OF USE

(71) Applicants: Gunter Gammerler, Bradenton, FL (US); Maximilian Frank, Osprey, FL (US)

(72) Inventors: Gunter Gammerler, Bradenton, FL (US); Maximilian Frank, Osprey, FL (US)

( * ) Notice: Subject to any disclaimer, the term of this patent is extended or adjusted under 35 U.S.C. 154(b) by 594 days.

(21) Appl. No.: 16/262,619

(22) Filed: Jan. 30, 2019

(65) Prior Publication Data

US 2019/0159514 A1 May 30, 2019

Related U.S. Application Data

(63) Continuation-in-part of application No. 15/254,246, filed on Sep. 1, 2016, now Pat. No. 10,206,424.

(51) Int. Cl.

| | |
|---|---|
| ***A24F 1/30*** | (2006.01) |
| ***C22C 9/05*** | (2006.01) |
| ***C22C 19/05*** | (2006.01) |
| ***A24F 40/46*** | (2020.01) |
| ***A24F 40/485*** | (2020.01) |
| ***A24F 40/20*** | (2020.01) |
| ***C22C 38/06*** | (2006.01) |

(Continued)

(52) U.S. Cl.

CPC ..... *A24F 1/30* (2013.01); *A24F 40/46* (2020.01); *A24F 40/485* (2020.01); *C22C 9/05* (2013.01); *C22C 9/06* (2013.01); *C22C 19/05* (2013.01); *C22C 19/058* (2013.01); *C22C 38/06* (2013.01); *C22C 38/18* (2013.01); *A24F 40/20* (2020.01)

(58) Field of Classification Search

None

See application file for complete search history.

(56) References Cited

U.S. PATENT DOCUMENTS 474,797 A * 5/1892 Mitchell ..... F24H 3/002 392/373

784,981 A * 3/1905 Buckley ..... A45D 20/12 392/379

(Continued)

OTHER PUBLICATIONS

European Search Report for Appl. 17847551.3, dated Jun. 29, 2020.

(Continued)

*Primary Examiner* — Thor S Campbell

(74) *Attorney, Agent, or Firm* — Zagrebelsky Law P.A.; Robert Varkonyi

(57) ABSTRACT

A radiant heater adapted to fit on the head of a hookah. The heater uses one or more resistance ribbons to generate heat which is transferred to shisha in the hookah. The heater includes a chimney which surrounds the resistance ribbon and provides a chimney siphoning to remove heat when the heater is not in use and a heat transfer plate which includes one or more projections to vent excess heat. Air is drawn through the top of the chimney and is heated by the resistance ribbon. The heated air mixes with cool air drawn through a ventilation space below the chimney and the mixed air drawn through one or more vents in a heat plate. The heat transfer plate and hot air vaporize the shisha.

20 Claims, 15 Drawing Sheets

(51) Int. Cl.
*C22C 38/18* (2006.01)
*C22C 9/06* (2006.01)

(56) References Cited

U.S. PATENT DOCUMENTS 813,113 A * 2/1906 Pratt ..... D06F 49/00 392/373
1,161,667 A * 11/1915 Hays ..... F24H 3/002 392/373
1,308,211 A * 7/1919 Walder ..... F24H 3/002 392/373
1,366,840 A * 1/1921 Scisinger ..... F24C 7/062 392/355
1,439,335 A * 12/1922 Selvatico ..... F24C 15/102 219/449.1
1,689,822 A * 10/1928 Gallup ..... F24C 7/043 392/355
1,755,204 A * 4/1930 Buffalow ..... F24H 3/002 392/373
1,901,038 A * 3/1933 Marshall ..... F24H 3/002 392/373
2,091,905 A 9/1935 Bensel et al.
2,277,151 A * 3/1942 Schoonmaker ..... F24H 3/0417 392/376
2,506,690 A * 5/1950 Stein ..... H05B 3/009 392/373
2,731,541 A * 1/1956 Houdry ..... G01N 27/16 219/552
2,900,483 A * 8/1959 Welch ..... F24C 15/2014 392/491
3,119,923 A * 1/1964 Gorman ..... F24H 3/002 392/373
3,400,248 A * 9/1968 Isomaa ..... A61H 33/063 392/373
3,492,457 A * 1/1970 Subt ..... F24H 1/103 219/207
3,889,690 A * 6/1975 Guarnieri ..... A24F 1/30 131/185
4,023,928 A * 5/1977 Haensel ..... A61L 9/03 422/49
4,133,318 A * 1/1979 Gross ..... A24F 1/30 131/173
4,523,935 A * 6/1985 Takagi ..... B01D 39/2093 219/205
D313,072 S * 12/1990 Welsh ..... D23/417
5,049,726 A * 9/1991 Higgins ..... H05B 3/742 219/462.1
5,053,603 A * 10/1991 Wagner ..... F01N 3/027 219/205
5,101,095 A * 3/1992 Wagner ..... F01N 3/027 123/549
5,334,818 A * 8/1994 Edwards ..... F24H 3/0405 219/537
6,885,810 B2 * 4/2005 Allwohn ..... A45D 20/12 392/385
7,544,331 B1 * 6/2009 Pettaway ..... A61L 9/03 422/125
7,565,908 B2 * 7/2009 Liu ..... A24F 1/30 131/173
10,206,424 B1 * 2/2019 Gammerler ..... H05B 3/76
10,537,690 B2 * 1/2020 Trzecieski ..... A24F 1/32
10,561,804 B1 * 2/2020 Culligan ..... H05B 1/0244
10,820,626 B2 * 11/2020 Benjamignan ..... H01M 10/486
2006/0086365 A1 * 4/2006 Liu ..... A24F 1/30 131/173
2010/0212678 A1 * 8/2010 Bishara ..... A24F 1/30 131/173
2010/0212679 A1 * 8/2010 Bishara ..... A24F 1/30 131/173
2014/0255014 A1 * 9/2014 Bishara ..... A24F 1/30 392/488
2014/0314397 A1 * 10/2014 Alima ..... A24F 40/46 392/386
2016/0029696 A1 * 2/2016 Obeidallah ..... A24F 1/30 131/329
2016/0131360 A1 * 5/2016 Isayan ..... F22B 1/28 392/386
2019/0159514 A1 * 5/2019 Gammerler ..... C22C 9/06
2021/0251283 A1 * 8/2021 Gammerler ..... A24F 40/20

OTHER PUBLICATIONS https://www.merriam-webster.com/dictionary/flange (last accessed Nov. 1, 2021).
https://www.merriam-webster.com/dictionary/spacer (last accessed Nov. 1, 2021).

* cited by examiner

CONSISTENT RADIANT HEATING SYSTEM FOR VAPORIZING TOBACCO AND METHOD OF USE

CROSS REFERENCE TO RELATED APPLICATIONS

This application is a continuation-in-part application of U.S. application Ser. No. 15/254,246, entitled: "Radiant Heating System for Vaporizing Tobacco and Method of Use", filed Sep. 1, 2016, herein incorporated by reference in its entirety.

FIELD OF INVENTION

The invention relates generally to an electrical radiant heating system and method of vaporizing tobacco. Specifically, the invention discloses one or more electrical heating coils disposed in a chimney designed to maintain consistent temperature to heat tobacco thereby vaporizing the tobacco without burning it.

BACKGROUND OF INVENTION

Hookahs are devices used in smoking combusted materials such as tobacco. They consist of a head, body, vase, and hose. The head is a bowl formed of clay, marble, or glass, that contains coal and tobacco separated by a screen or perforated metal foil. Commonly, a windscreen is placed on the upper opening of the head, limiting air exposure to the coal, and reducing the burn rate, and hence temperature, of the coal. The body consists of a pipe that joins the head to the vase. The lower end of the pipe is submerged in water to provide a filtration system for the tobacco vapor. In some variations, a diffuser is fitted to the end of the pipe, reducing the size of the bubbles forming as air is drawn from the body into the water. The vase is a water-filled container possessing at least an input for the body and an output for one or more hoses. Finally, the hose is a material, commonly flexible, fitted to the vase and terminating in a mouthpiece, allowing a user to drawn air through the hookah, thereby heating the coals and vaporizing the tobacco, which is then drawn through the pipe and water and into the hose for inhalation by the user.

Tobacco is placed in the head of the hookah and heated to generate smoke, traditionally using charcoal that is separated from the tobacco by a perforated foil, glass, or metal screen. Hot air from the charcoal vaporizes the tobacco. Smoke vapor is drawn through a channel in the body and into the vase as a user draws air through the mouthpiece. As the body extends into water in the vase, the smoke vapor bubbles in the water, thereby filtering the raw smoke vapor. The smoke vapor then enters a head space in the vase, which is in direct communication with the one or more hoses and is drawn to the user.

The origins of the hookah are traced to Rajasthan province in north western India or Persia, and consisted of a simple and rugged structure, typically derived from a coconut shell base with a tube and head attached, which is where the alternative name for the device—nārghile (sanskrit, n ārikela, coconut)—originated. In the 1500s, Abu-al Fath Gilani was attributed with the general development of the hookah as it is commonly known today. Though as the hookah was adopted in the Ottoman Empire, hookahs grew in size and complexity, and changed materials, using less wood and more brass and glass.

However, the traditional hookah rely upon charcoal, which introduces unwanted chemicals and carcinogens into the vapor smoke, and forms dirty byproducts like soot, some of which can access the tobacco. Electric solutions have thus far been unsuccessful, as the designs cause overheating of the tobacco or result in wide temperature variations in the heating element, which reduces proper vaporization and negatively affects a hookah user's experience. Furthermore, as air is drawn past the electric heating elements of previous designs, the coils cool down. Accordingly, the previous designs drop in temperature, and cease properly vaporing the tobacco, upon inhalation, or compensate by increasing the initial coil temperature, which burns the tobacco during the initial inhalation. As such, there is an unmet need in the art for a clean and effective method to vaporize tobacco.

SUMMARY OF THE INVENTION

Disclosed is a radiant heating system, comprising a heating element, a chimney, a spacer forming a ventilation space below the chimney, and an electrical source.

The heating element is formed of one or more heating coils of resistance wire. The resistance wire can be an alloy of nickel, aluminum, copper, manganese, iron, chromium, and silicon. Non-limiting examples include an alloy of nickel (80%) to chromium (20%), an alloy of iron (62.5%-76%) to chromium (20%-30%) to aluminum (4%-7.5%), an allow of copper (55%) to nickel (45%), an alloy of copper (86%) to manganese (12%) to nickel (2%), or an alloy of nickel (75%) to chromium (20%) to aluminum (2.5%) to copper (2.5%). The heating element is optionally one heating coil, either disposed in a single coil or disposed into two coils, one above the other, connected by a screw-like spiral at the center of the two coils. The heating coil is optionally a single ribbon coil or a double-back ribbon coil. Alternatively, the heating element is multiple coils configured as one above the other, connected by a conductive material. The conductive material can be formed into a bracket or clip, which attaches to one end of each heating coil. For example, the radiant heater optionally includes a first heating coil of resistive ribbon having a first end and a second end. Alternatively, the first end of the first heating coil is circumscribed by the first heating coil and the second end of the first heating coil extends from a coil in the first heating coil, i.e. the coil wraps around the first end, with the second end extending away from the wrap. A second heating coil of resistive ribbon, with a first end and a second end, is configured similarly, with the first end of the second heating coil is circumscribed by the second heating coil and the second end of the second heating coil extends from a coil in the second heating coil. The uppermost edge of the heating element is exposed ambient environmental conditions, such as an open face, netting, cage, or other material that permits free flow of air. Examples include where a single heating coil is exposed on its upper edge to the ambient environment or where multiple heating coils are used, the upper edge of the uppermost heating coil is exposed to the ambient environment. The heating coils optionally possess a circular cross section, triangular cross section, square cross section, pentagonal cross section, hexagonal cross section, heptagonal cross section, octagonal cross section, or nonagonal cross section. In some variations, the heating element comprises a plurality of heating coils, formed of an upper heating coil and lower heating coil. The upper heating coil is formed of a resistive ribbon having a first end and a second end, and where the first end of the upper heating coil is circumscribed by the upper heating coil and the second end of the upper heating coil extends from a coil in the upper heating coil to form an upper heating coil connector. An upper heating coil electric connector, formed of an electrically conductive material, provides electrical energy to the upper heating coil and is in electrical communication with the upper heating coil connector. The lower heating coil is formed of resistive ribbon having a first end and a second end, where the first end of the lower heating coil is circumscribed by the lower heating coil and the second end of the lower heating coil extends from a coil in the lower heating coil to form a lower heating coil connector. A lower heating coil electric connector, formed of an electrically conductive material, provides electrical energy to the lower heating coil and is in electrical communication with the lower heating coil connector.

The one or more heating coils are formed of resistance ribbon. In some embodiments, the resistance ribbon possesses a thickness and width of about 0.0285 inches×about 0.1875 inches (0.72 mm×4.7 mm). For example, the ribbon can have a thickness of 0.025 inches, 0.026 inches, 0.027 inches, 0.0275 inches, 0.028 inches, 0.0285 inches, 0.029 inches, 0.0295 inches, 0.030 inches, 0.0305 inches, 0.031 inches. The ribbon can have an exemplary width of 0.165 inches, 0.170 inches, 0.175 inches, 0.18 inches, 0.1825 inches, 0.185 inches, 0.1875 inches, 0.189 inches, 0.19 inches, 0.1925 inches, 0.195 inches. However, these numbers are examples only and not intended to be limiting. Of particular note, the wire should possess dimensions sufficient to form a heating element having a final impedance of about 0.7Ω. Nonlimiting examples include 0.6Ω, 0.625Ω, 0.65Ω, 0.66Ω, 0.67Ω, 0.68Ω, 0.69Ω, 0.70Ω, 0.71Ω, 0.72Ω, 0.725Ω, 0.73Ω, 0.74Ω, 0.75Ω, 0.76Ω, 0.77Ω, 0.78Ω, 0.79Ω, and 0.80Ω. Increasing the width and/or thickness reduces resistance and requires a longer length to obtain the resistance needed. However, it would be known to one of skill in the art to form the required resistance ribbon.

A heating coil connector is disposed in electrical communication with the first end of the first heating coil and the first end of the second heating coil. The heating coil connector is formed of a conductive material capable of withstanding temperatures above 1000° F. Examples include steel or steel alloys such as stainless steel.

The chimney an interior space defined by at least one wall and dimensioned to accept the heating element within the interior space, i.e. is structured to circumscribe a portion of the heating element. Accordingly, the chimney is dimensioned to accept to the exterior circumference of the first heating coil and the exterior circumference of the second heating coil. The chimney optionally has a circular cross section, triangular cross section, square cross section, pentagonal cross section, hexagonal cross section, heptagonal cross section, octagonal cross section, or nonagonal cross section, and is formed from any material known in the art that is capable of handling temperatures in excess of 600° F. Nonlimiting examples include heat-treated glass, borosilica glass, stainless steel, steel, and aluminum. The chimney is dimensioned such that 50% or less of the heating element is circumscribed by the chimney. As such, the uppermost edge of the heating element extends beyond the upper edge of the at least one wall of the chimney. In some variations, a second heating coil is disposed above the chimney, i.e. is not circumscribed by the chimney.

Variations of the invention include a shield disposed below the at least one spacer. Nonlimiting examples of shields include metal foil, a metal plate, or metal plate having a plurality of holes. Optionally, the shield is formed of cast aluminum, A10 aluminum, A12 aluminum, aluminum foil, brass, gold, or stainless steel.

In some variations, the one or more heating elements include at least one insulated mounting bracket disposed on an exterior circumference of the heating coil, or heating coils in the embodiment where multiple heating coils are utilized. In some variations, more than one insulated mounting bracket is provided. The insulated mounting bracket or brackets are optionally configured to hold the heating coil in place in the radiant heater, including those sections within the chimney. In specific variations, the mounting bracket includes an upper insulated mount, which is formed of an upper insulated bracket with an upper edge and lower edge and dimensioned to fit within an opening in an upper mount support, and at least one insulated bracket finger disposed on the lower edge of the upper insulated bracket. Additionally, a lower insulated mount is provided, which is formed of a lower insulated bracket with an upper edge and lower edge and dimensioned to fit within an opening in a lower mount support, and at least one insulated bracket finger disposed on the upper edge of the lower insulated bracket. The optional supports support the upper edge and lower edge of the heating element. In examples of the invention including multiple heating coils, the upper insulated mount supports the uppermost heating coil and the lower insulated mount supports the lowermost heating coil. Regardless of the variation of heating coil, the upper edge of the upper-most heating element is exposed to ambient environmental conditions, i.e. there is no lid, cap, or other structure disposed above the heating coils to prevent heat from escaping. Additional variations of the invention include a middle-insulated mount. The middle-insulated mount is formed of a middle-insulated bracket having a body with an upper edge and a lower edge, and at least one insulated bracket finger disposed on the upper edge of the middle-insulated bracket and at least one insulated bracket finger disposed on the lower edge of the middle-insulated bracket. The middle mount support optionally includes both an upper heating coil bracket and lower heating coil bracket. The upper heating coil bracket is disposed on the support body above the at least one mount support bar opening, dimensioned to accept the second end of the upper heating coil. The upper heating coil electric connector is disposed adjacent to the upper heating coil bracket. The lower heating coil bracket is disposed on the support body below the at least one mount support bar opening, dimensioned to accept the second end of the lower heating coil. The lower heating coil electric connector is disposed adjacent to the lower heating coil bracket.

Variations of the invention include a support structure of two mounting brackets. An upper mounting bracket formed of at least a first upper mount disposed on a first side of the upper mounting bracket, a second upper mount disposed on a second side of the upper mounting bracket and dimensioned to circumscribe the upper edge of the heating element. Optionally, the upper mounting bracket includes a plurality of upper bracket retention bars. The upper bracket retention bars are disposed on the lower face of the upper mounting bracket. In variations of the invention using the retention bars, the chimney extends partially between the upper mounting bracket and the lower mounting bracket. To illustrate the chimney extending partially between the two mounting brackets, without being limited to any particular example, the chimney can extend halfway between the two mounting brackets, one-third the distance between the two mounting brackets, two-thirds the distance between the two mounting brackets, or three-quarters the distance between the two mounting brackets. A lower mounting bracket, formed of a body, whereby the at least one spacer is disposed on the upper edge of the lower mounting bracket. At least a second spacer is disposed on the upper edge of the body of the lower mounting bracket, such that the second spacer is disposed opposite the first lower mount. Other variations of the lower mount include a third spacer disposed on an upper face of the lower mount, and dimensioned to provide the ventilation space disposed between the lower edge of the chimney and the upper edge of the lower mounting bracket. The lower mount can include a fourth spacer, fifth spacer, sixth spacer, or a number of spacers as would be obvious to one of skill in the art upon review of this disclosure, with the proviso that the spacers cannot unduly restrict airflow. The mounting brackets are dimensioned such that the chimney fits within the mounting brackets. Optionally, the upper mounting bracket includes a bracket plate having a body formed of a horizontal plate and at least one vent disposed on the body of the bracket plate. In these variations, the lower mounting bracket includes a body that has similar horizontal dimensions to the horizontal plate, i.e. can form a box or other geometric figure when vertical walls are added. The body extends from the lower mounting bracket and terminates in a compression end. A compression plate dimensioned to fit on the compression end of the second lower mount, and includes a compression face and a compression slot disposed on the compression face.

The support structure and heat transfer plate can be formed of cast aluminum, A10 aluminum, A12 aluminum, brass, gold, silver, stainless steel. The insulated brackets and spacers are optionally formed of Macor, a fluorphlogopite mica-borosilicate ceramic having a composition of about 46% silica, about 17% magnesium oxide, about 16% aluminum oxide, about 10% potassium oxide, about 7% boron trioxide, and about 4% fluorine. The insulated brackets and spacers are alternatively a composition of 65-70% silica, 20-25% aluminum trioxide ($Al_2O_3$), less than 1% magnesium oxide, less than 1% calcium oxide, 3-5% potassium/sodium oxide (K, $Na_2O$), less than 1% titanium dioxide, 102% iron oxide ($Fe_2O_3$), and 1-2% chromium oxide ($Cr_2O_3$). The insulation is optionally AP 508 gray porcelain (Akron Porcelain & Plastics Co., Akron, Ohio).

The ventilation space is disposed between the lower edge of the chimney and the spacer or lower mounting bracket, where the ventilation space is about 1 mm to about 10 mm. Non-limiting examples include 1.0 mm, 1.25 mm, 1.5 mm, 1.75 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.25 mm, 6.5 mm, 6.75 mm, 7.0 mm, 7.25 mm, 7.5 mm, 7.75 mm, 8.0 mm, 8.25 mm, 8.5 mm, 8.75 mm, 9.0 mm, 9.25 mm, 9.5 mm, 9.75 mm, and 10 mm. In some variations, the ventilation space is 3 mm.

The electrical source in an electrical communication with the at least one heating coil. Nonlimiting examples include a current-regulated electrical source. The electrical source is optionally current adjustable. Useful adjustments in the current are from 5 amps to 25 amps. Nonlimiting examples include 5 amps, 5.5 amps, 6 amps, 6.5 amps, 7 amps, 7.5 amps, 8 amps, 8.5 amps, 9 amps, 9.5 amps, 10 amps, 10.5 amps, 11 amps, 11.5 amps, 12 amps, 12.5 amps, 13 amps, 13.5 amps, 14 amps, 15 amps, 16 amps, 17 amps, 18 amps, 19 amps, 20 amps, 21 amps, 22 amps, 23 amps, 24 amps, or 25 amps. The current is dependent upon the heating element, and the electrical system is optionally designed to operate between 5V and 50V. Nonlimiting examples include 5V, 6V, 7V, 8V, 9V, 10 V, 11V, 12V, 13V, 14V, 15V, 16V, 17V, 18V, 19V, 20V, 21V, 22V, 23V, 24V, 25V, 26V, 27V, 28V, 29V, 30V, 31V, 32V, 33V, 34V, 35V, 36V, 37V, 38V, 39V, 40V, 41V, 42V, 43V, 44V, 45V, 46V, 47V, 48V, 49V, or 50V.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

As used herein, "about" means approximately or nearly and in the context of a numerical value or range set forth means ±20% of the numerical.

As used herein, "hookah" refers to a device designed for vaporizing and smoking favored materials, the vapor of which is run through a liquid before inhalation. The hookah is typically used to smoke shisha, and may have a single host or multiple hoses for inhalation.

As used herein, "heating coil" means a heating element wrapped around itself, regardless of shape. For example, the heating coil may be spiral-shaped, with each wrap radially circumscribed by the preceding wrap, or a polygonal shape, such as triangular, square, pentagonal, hexagonal, heptagonal, and octagonal. Other shapes would be readily apparent and are envisioned in the invention.

Figure 3:
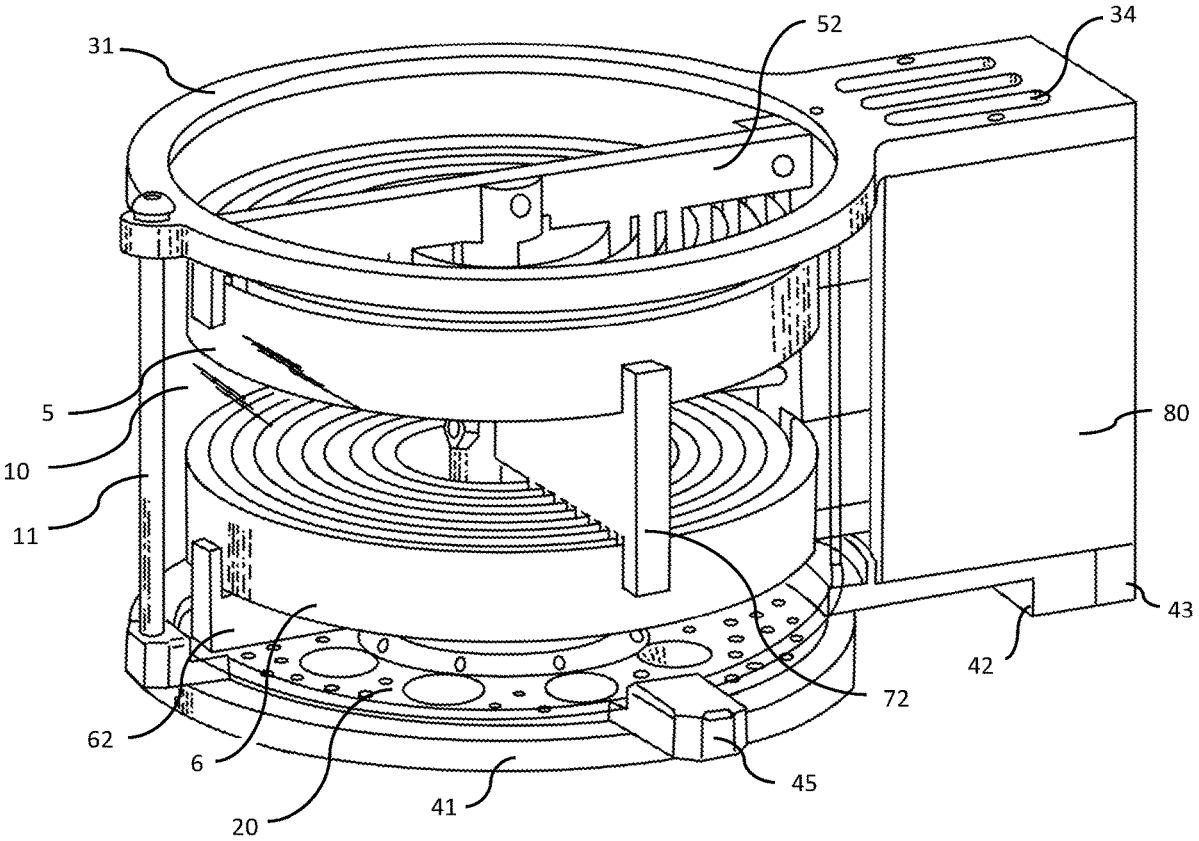
FIG. 3 is an isometric view of a second embodiment of the heating element of the invention.

As used herein, "upper" and "lower" or "bottom" are referenced on the image depicted in FIG. 3. "Upper" means any portion of the heater directed to the top in FIG. 3. For example, reference number 5 is above reference number 6. The "upper edge" references the terminal section of an element directed at the top of the Figure. "Lower" or "bottom" is directed toward the bottom of FIG. 3.

As used herein, "ambient environment" and derivations thereof mean the environment surrounding and outside of the device, as compared to the interior regions and spaces of the device. As a non-limiting example, the ambient environment includes the humidity, temperature, and air particulates 6 inches above the heating elements.

As used herein, "projection" means any structure which by design, is raised or protrudes beyond the face of the structure upon which the projection is disposed As used herein, "circumference" means the outermost boundary of the referenced structure.

As used herein, "chimney effect", also called stack effect, is the movement of air into and out of a structure due to differential air buoyancy of hot air and warm air. The drop in density as air or gas is heated results in the air or gas rising above denser, cooler air or gas.

As used herein, "arc-shaped" means that the structure has a convex or concave shape that resemble sections of circles, ellipses, involute curves, and spirals, without forming a full circle, or ellipse.

As used herein, "disposed along" means that the structure either directly or indirectly in contacts the surface of another structure, while not physically attached to the other structure.

As used herein, "female-threaded post" means a structure that has threading in a receptacle that receives a protrusion from another structure, and is used in compliance with the American National Standard Pipe Thread standards, or national pipe thread standards. In some embodiments, the term "female-threaded post" means a solid bar ending in a tubular or other hollow geometric structure that possesses one or more threads.

As used herein, "male-threaded post" means a structure that has threading in on a protrusion that can be accepted by a receptacle of another structure, and is used in compliance with the American National Standard Pipe Thread standards, or national pipe thread standards.

As used herein, "resistive ribbon" means a resistance wire having a length, width, and thickness, where the width is at least 2 times the value of the thickness. In some embodiments, the resistive ribbon possesses both high resistivity and oxidation resistance.

As used herein, "resistance cable" means a resistance wire having a length, width, and thickness, where the width is less than 2 times the value of the thickness. In some embodiments, the resistive cable possesses a width than is substantially the same as the thickness, i.e. possess a 1:1 ratio. Circular wire is of particular note, having a width to thickness ratio of close to, or equal to 1:1.

Figure 15:
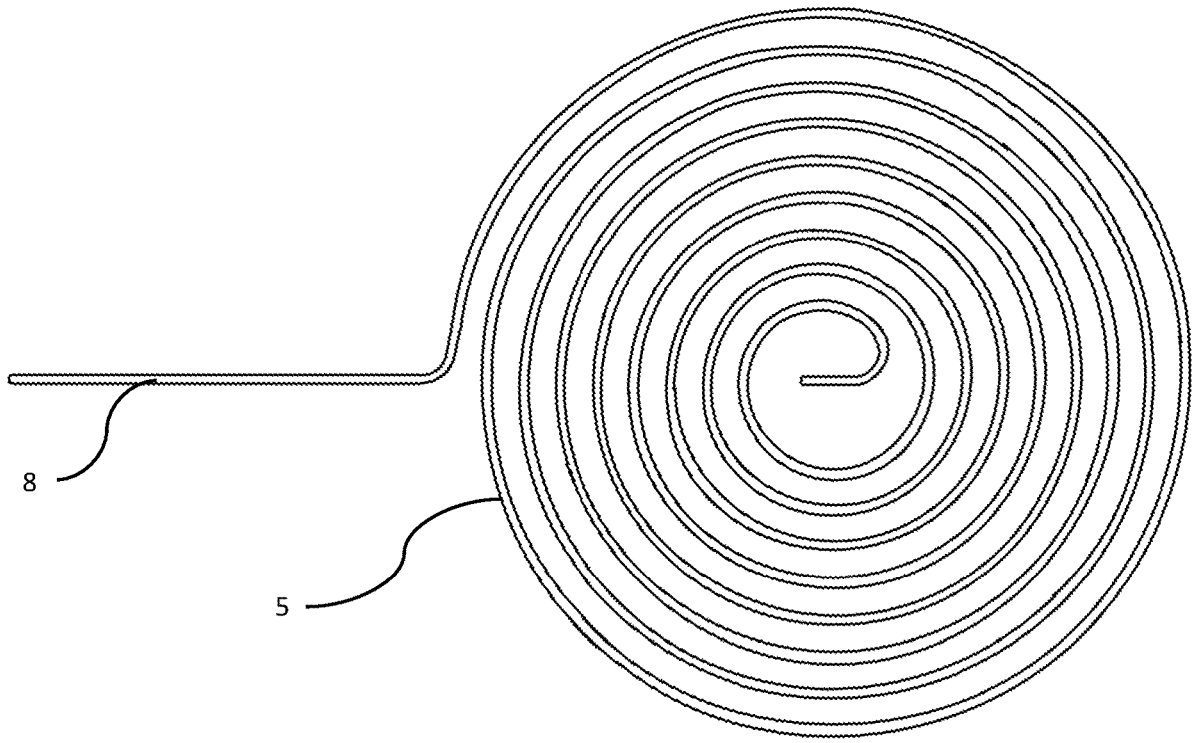
FIG. 15 is a top down view of a first embodiment of a heating element of the invention.

As used herein, "a single ribbon coil" means a coil wrapped around itself, having a first terminal end outside the wrapping and a second terminal end at the core of the wrapping, regardless of shape. For example, where the heating coil is spiral-shaped, the first terminal end extends from a radially circumscribed coil and the second terminal end is disposed at the center-most point of the coil, as seen in FIG. 15.

As used herein, "a center spiral two-layer ribbon coil" means a coil wrapped around itself, wherein the central 1/20-1/5 of the coil is spiraled from a lower tier coil to an upper tier coil, similar to the threads of a screw, forming two layers or tiers of heater coil.

Figure 16:
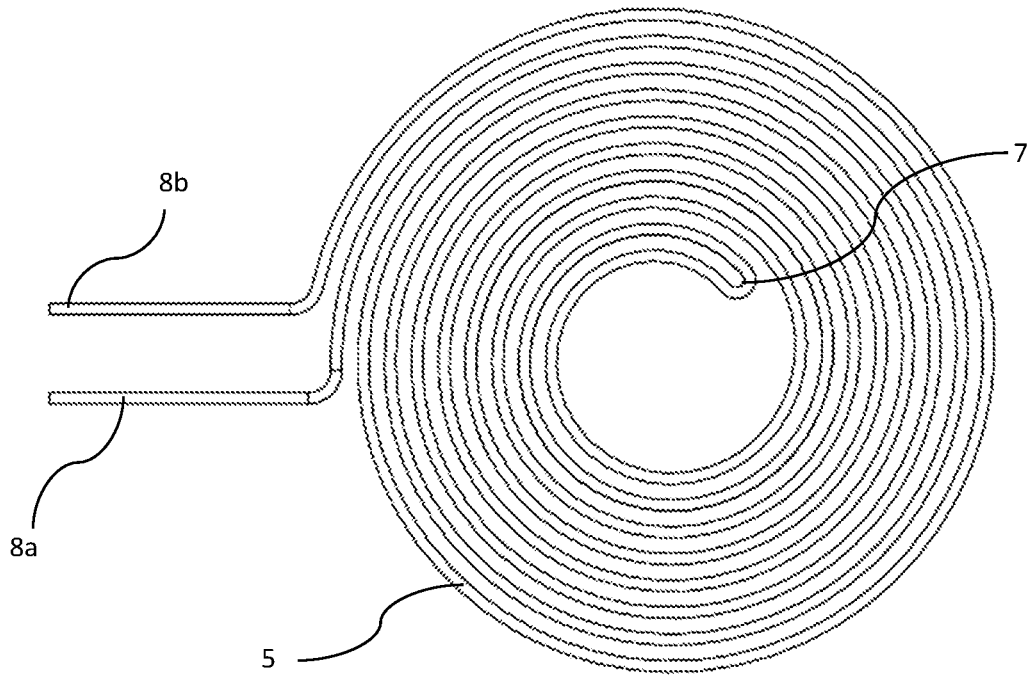
FIG. 16 is a top down view of a second embodiment of a heating element of the invention.

As used herein, "double-back ribbon coil" means a coil folded upon itself and subsequently wrapped around itself. The double-back ribbon coil has a first terminal end and a second terminal end disposed outside the wrapping. The center-most point of the coil possesses the fold, as seen in FIG. 16.

As used herein, "substantially" means largely if not wholly that which is specified but so close that the difference is insignificant.

As used herein, "partially" means 75% of the entire distance or less. Non-limiting examples include 75%, 70%, 65%, 60%, 55%, 50%, 45%, 40%, 35%, 30%, 25%, 20%, 15%, 10%, 5%, or 2.5%.

A hookah electric radiant heating system is provided for vaporizing tobacco without burning the tobacco. Burning or charring tobacco results in unpleasant volatile gases, ultrafine particulates and ash, which reduces the smoking experience and negatively affects the health of a hookah user. The system includes a heating element, set in an open faced mounting ring such that the heating element optionally moves in relation to the mounting ring to control heat. The system is designed to transfer heat to a heat transfer plate which applies heat to tobacco in a hookah head.

Example 1

Figure 1:
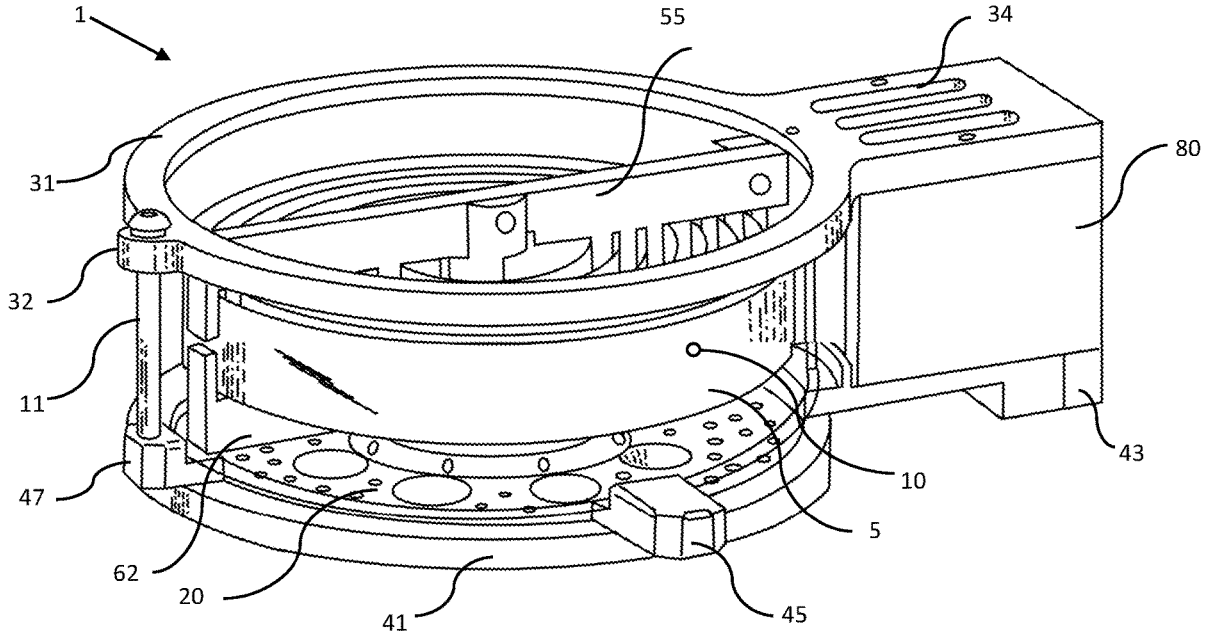
FIG. 1 is an isometric view of a first embodiment of the heating element of the invention.

Radiant heater 1 is composed of a heating element, chimney 10, upper bracket 30, and lower bracket 40, seen in FIG. 1. Chimney 10 is made of borosilicate glass, or a material possessing similar thermal properties, and includes chimney upper edge 10*a* and chimney lower edge 10*b*. Chimney 10 is tubular and dimensioned to permit air flow past the heating element. The chimney is fixed by lower bracket 40 and upper bracket 30.

Figure 2:
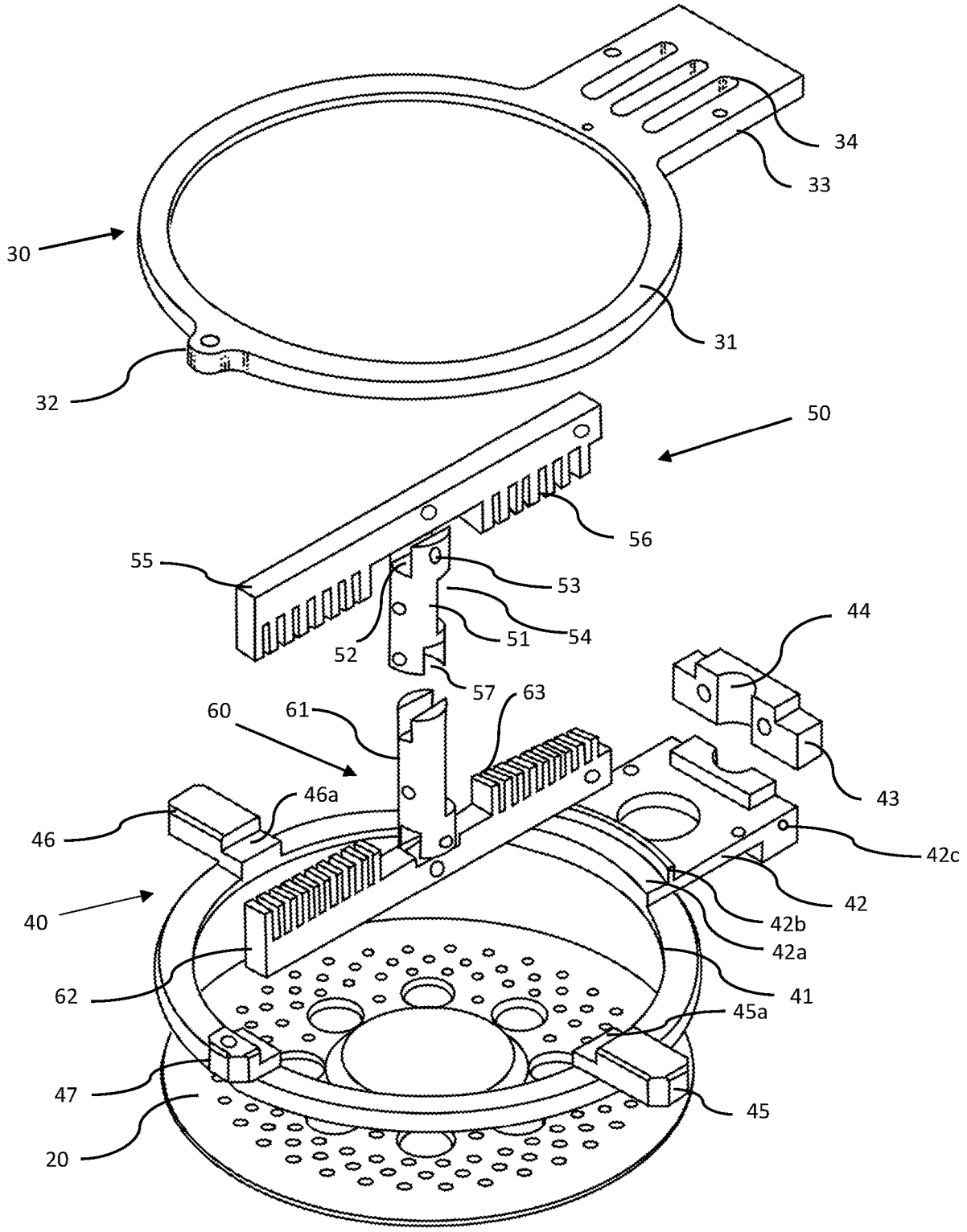
FIG. 2 is an isometric, breakaway view of a first embodiment of the radiant heater of the invention.

Upper bracket 30 is formed of cast aluminum, and has upper bracket ring 31 with upper ring mount 32 on a first side and upper bracket plate 33 disposed opposite to the upper ring mount, as seen in FIG. 2. At least one upper bracket vent 34 is disposed on upper bracket plate 33. Lower bracket 40 is formed of lower bracket ring 41 having lower ring mount 47 on a first side and oriented below upper ring mount 32, and lower bracket plate 42 opposite lower ring mount 47, made of cast aluminum. Lower bracket plate 42 includes an elevated arc-shaped chimney spacer 42*a* and chimney mount 42*b* on a first side and compression face 42*c* opposite the chimney mount. Compression plate 43 is dimensioned to fit on compression face 42*c* of lower bracket plate 42, and includes compression slot 44. Compression plate 43 includes plate mount face having compression slot 44 disposed on the plate mount face. First lower fitting tab 45 and second lower fitting tab 46 are disposed on lower bracket ring 41, and include first fitting tab chimney spacer 45*a* and first fitting tab chimney spacer 46*a*. Chimney 10 is placed onto the chimney spacers of lower bracket plate 42, lower fitting tab 45, second lower fitting tab 46, and lower ring mount 47, forming a space between chimney lower edge 10*b* and lower bracket 40. Upper bracket 30 is placed on chimney upper edge 10*a* and mounting pin 11 used to fix upper ring mount 32 to lower ring mount 47. In some embodiments, mounting pin 11 includes female-threaded ends, and a screw attaches the lower end of mounting pin 11 to lower ring mount 47 and a screw attaches the upper end of mounting pin 11 to upper ring mount 32. In alternative embodiments, mounting pin 11 includes a male-threaded lower end and female-threaded upper end. Mounting pin 11 is screwed into lower ring mount 47 and a screw attaches the upper end of mounting pin 11 to upper ring mount 32. Electric supply housing 80 is placed between upper bracket plate 33 and lower bracket plate 42, and screwed to upper bracket 30 and lower bracket 40.

The radiant heater has a single heating element, formed of upper heating coil 5. Upper heating coil 5 is a resistive wire ribbon formed of nickel (80%) to chromium (20%) resistance ribbon with a thickness of 0.0285 inches and a width of 0.1875 inches, a resistance of 0.7Ω, and coiled such that the coils are a predetermined set distance. Upper heating coil 5 terminates in upper heating coil connector 8, permitting an electrical connection to be made between a power supply and the resistive wire ribbon. An electrical wire is mounted into the radiant heater using compression slot 44 of compression plate 43. The wire is placed into the compression slot and the compression plate tightened, thereby placing pressure on the wire.

Upper heating coil 5 is preferably oriented into the heater using upper insulated mounting bracket 50 and lower insulated mounting bracket 60. Upper mounting bracket support 51 includes bracket mount 52 disposed on its upper face and bracket lock 53 disposed on the body and designed to fix upper insulated bracket 55 to upper mounting bracket support 51. Preferably, upper mounting bracket support 51 and upper insulated bracket 55 have complementary mounting holes or other apertures thereby allowing bracket lock 52 to fix upper insulated bracket 55 to upper mounting bracket support 51. Upper insulated bracket 55 is formed of fluorphlogopite mica-borosilicate ceramic insulation (Macor, Corning Inc., Corning, N.Y.). The lower edge of upper insulated bracket 55 ends in upper insulated bracket finger 56, dimensioned to accept the coils of upper heating coil 5. Similarly, lower insulated mounting bracket 60 includes lower mounting bracket support 61 with a slot to accept lower insulated bracket 65. The lower mounting bracket support and lower insulated bracket preferably include mounting hole or aperture 63 adapted to fix lower insulated bracket 65, constructed of a material similar to the upper insulated bracket, to lower mounting bracket support 61. Lower insulated bracket finger 66 is disposed on the upper edge of lower insulated bracket 65.

Optionally, the radiant heater uses a heating plate 20. Alternative embodiments use a piece of metal foil having holes disposed along its body. Further, embodiments of the heater can include the lower mounting bracket described in Examples 5 through 7.

Example 2

Radiant heater 1 is composed of a heating element, chimney 10, heating plate 20, upper bracket 30, middle bracket 70, lower bracket 40, electric supply housing 80, and supply system (not shown), as seen in FIG. 3. The heating element is comprised of upper heating coil 5 and lower heating coil 6. Upper heating coil 5 and lower heating coil 6 are formed of NiCr resistive wire ribbon, with a content of nickel (80%) to chromium (20%). The heating coils have a thickness of 0.0285 inches and a width of 0.1875 inches, and upper heating coil 5 has 8 windings in the single ribbon coil design, whereas lower heating coil 6 has 10 windings in the single ribbon coil design. The ratio of windings in the coil can be modified by one skilled in the art. However, upper heating coil preferably has a heat ratio to the lower heating coil of 1:2, i.e. upper heating coil generates 50% heat as the lower heating coil, thereby permitting air to flow through the chimney via a "chimney effect".

Figure 4:
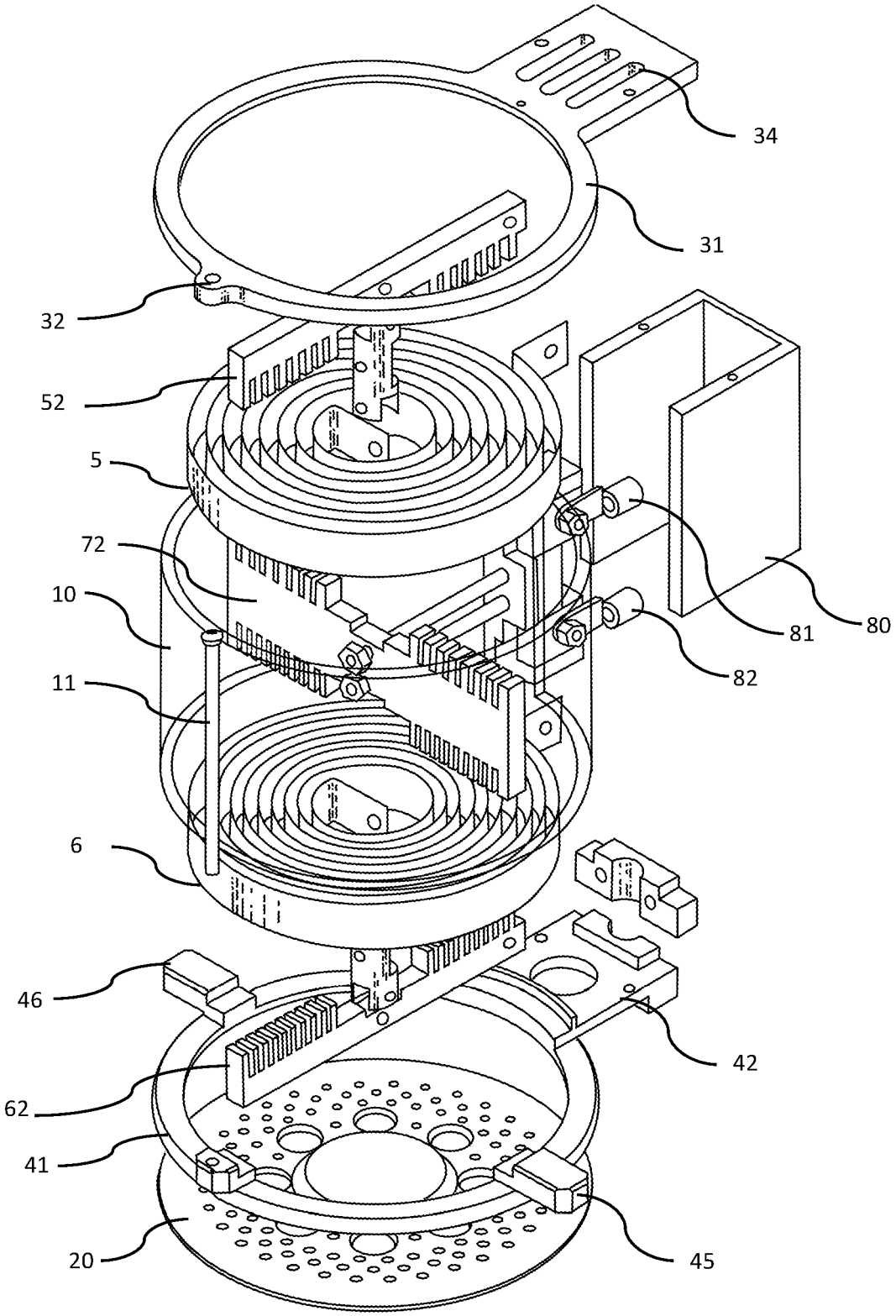
FIG. 4 is an isometric, breakaway view of a second embodiment of the radiant heater of the invention.

Upper heating coil 5 is oriented in radiant heater 1 on its upper edge by upper insulated mounting bracket 50, seen in FIG. 4. Upper insulated mounting bracket 50 includes upper mounting bracket support 51, which has bracket mount 52 disposed on its upper face and bracket lock 53 disposed on the body and designed to fix upper insulated bracket 55 to upper mounting bracket support 51. Bracket lock 52 is a pin or screw in the disclosed embodiment. Upper insulated bracket 55 is formed of fluorphlogopite mica-borosilicate ceramic insulation (Macor, Corning Inc., Corning, N.Y.), and includes a plurality of upper insulated bracket fingers 56 on the lower edge of the insulated bracket, and spaced to ensure the windings of upper heating coil 5 remain at the predetermined spacing. Upper coil slot 54 is disposed along the length of upper mounting bracket support 51, and has an opening dimension of 0.1875 inches, i.e. is dimensioned to accept upper heating coil 5. Middle bracket interface 57 is disposed on the lower face of upper mounting bracket support 51, and dimensioned to accept middle insulated bracket 72.

Figure 5:
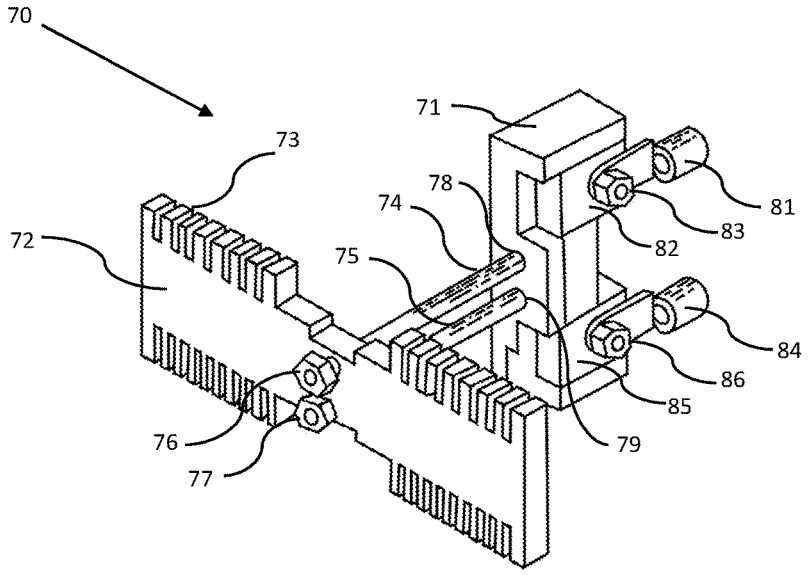
FIG. 5 is an isometric view of a middle insulated spacer of the second embodiment of the radiant heater of the invention.

Middle bracket 70 is disposed below upper heating coil 5 and provides supper for upper heating coil 5 and spacing between upper heating coil 5 and lower heating coil 6. Middle insulated mounting bracket 70 is supported by middle mounting bracket support 71, seen in FIG. 5. First middle mounting support bar 74 affixes to middle mounting bracket support 71, such as where first middle mounting support bar 74 has a male-threaded screw on its first end and screws into first middle bar opening 78. Second middle mounting support bar 75 affixes to middle mounting bracket support 71 on its first end, such as where second middle mounting support bar 75 has a male-threaded screw and screws into second middle bar opening 79. Middle insulated bracket 72 mounts to first middle mounting support bar 74 on its second end and second middle mounting support bar 75 on its second end. The second end of first middle mounting support bar 74 has a male-threaded screw and slides through first insulated bracket hole **72*a*. The second end of second middle mounting support bar 75 has a male-threaded screw and slides through second insulated bracket hole 72*b*. First middle mounting support lock 76 engages the male threads of the second end of first middle mounting support bar 74, and second middle mounting support lock 77 engages the male threads of the second end of second middle mounting support bar 75, thereby mounting middle insulated bracket 72. Middle insulated bracket 72 is made of insulated composite, such as that described for upper insulated bracket 55. A plurality of middle insulated bracket finger 73 are disposed on the upper and lower edges of middle insulated bracket 72, where the upper edge fingers support upper heating coil 5 and the lower edge fingers support lower heating coil 6**.

Lower insulated mounting bracket 60 acts in concert with the lower edge of middle insulated mounting bracket 70 to orient and fix lower heating coil 6. Lower mounting bracket support 61 includes lower bracket mount 62 disposed on its lower face and bracket lock 63 disposed on the body and designed to fix lower insulated bracket 65 to lower mounting bracket support 61. In some embodiments, lower mounting bracket support 61 has a complementary mounting hole or other aperture to a hole or aperture in lower insulated bracket 65, thereby allowing bracket lock 63 to fix lower insulated bracket 65 to lower mounting bracket support 61. Lower insulated bracket 65 is formed of an insulation similar or the same to upper insulated bracket 55. The upper edge of lower insulated bracket 65 ends in lower insulated bracket finger 66, dimensioned to accept the coils of lower heating coil 6.

Upper bracket 30 is similar to the variant described in Example 1, having upper bracket ring 31 with upper ring mount 32 on a first side and upper bracket plate 33 disposed opposite to the upper ring mount, as seen in FIG. 4. A plurality of upper bracket vents 34 are disposed on upper bracket plate 33. Lower bracket 40 is similar to Example 1, and has lower bracket ring 41 with lower ring mount 47 on a first side and oriented below upper ring mount 32, and lower bracket plate 42 opposite lower ring mount 47. Lower bracket plate 42 includes an elevated arc-shaped chimney spacer 42*a* and chimney mount 42*b* on a first side and compression face 42*c* opposite the chimney mount. Compression plate 43 is dimensioned to fit on compression face 42*c* of lower bracket plate 42, and includes compression slot 44. Compression plate 43 includes plate mount face having compression slot 44 disposed on the plate mount face. First lower fitting tab 45 and second lower fitting tab 46 are disposed on lower bracket ring 41, and include first fitting tab chimney spacer 45*a* and first fitting tab chimney spacer 46*a*.

Middle mounting bracket support 71 mounts inside electric supply housing 80, and includes upper heating coil bracket 82, dimensioned to accept upper heating coil connector 8, and lower heating coil bracket 85, dimensioned to accept lower heating coil connector 9. Upper heating coil bracket 82 attaches to upper heating coil electric connector 81 through upper heating coil lock 83, depicted in FIG. 5. Similarly, lower heating coil bracket 85 attaches to lower heating coil electric connector 84 through lower heating coil lock 86.

Figure 6:
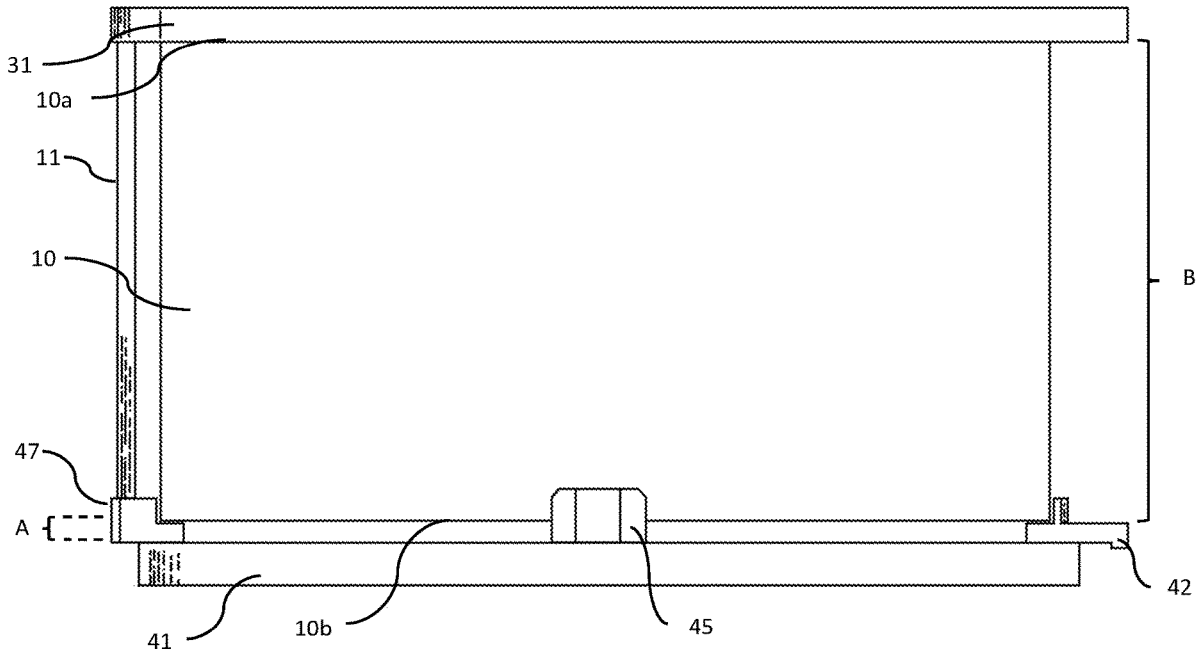
FIG. 6 is a side view of the radiant heater of the invention.

Chimney 10 is formed on borosilicate glass or material having a similar thermal dissipation property, and includes chimney upper edge 10*a* and chimney lower edge 10*b*, seen in FIG. 6. Chimney lower edge 10*b* is placed onto chimney spacer 42*a*, first fitting tab chimney spacer 45*a*, and first fitting tab chimney spacer 46*a*, thereby forming a ventilation space having height A. Height A is 2.5 mm. The height of chimney 10 and the ventilation space control the flow of heated and cool air, which mix and pass through a heat shield to tobacco, vaporizing the tobacco. Height B in the embodiment is 46 mm.

Figure 7:
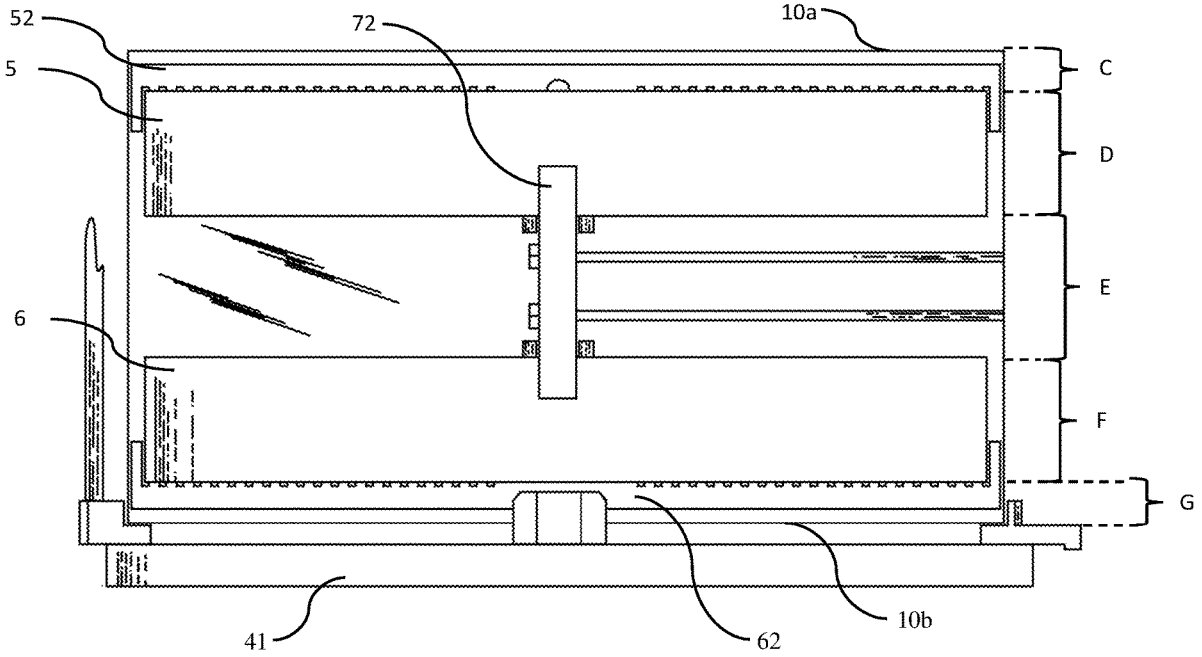
FIG. 7 is a side view of the radiant heater of the invention.

Height C is defined as the distance between chimney upper edge 10*a* and the upper edge of upper heating coil 5, as seen in FIG. 7. In the embodiments, height C is 6 mm. Height D is defined as the thickness of upper heating coil 5, and height F defined as the thickness of lower heating coil 5. In the embodiment, both height D and F are 9.5 mm, i.e. both coils have the same thickness. Height E is the distance between upper heating coil 5 and lower heating coil 6, which is controlled by middle insulated bracket 72. Height E is 15 mm in the embodiment. Height G is the distance between the lower edge of lower heating coil 6 and chimney lower edge 10*b*, which is 6 mm in the embodiment. Height H is the thickness of lower mounting bracket 40, which is 3.5 mm in the embodiment.

Optionally, the radiant heater uses heating plate 20. Alternative embodiments use a piece of metal foil having holes disposed along its body. Further, embodiments of the heater can include the lower mounting bracket described in Examples 5 through 7.

Example 3

Figure 8:
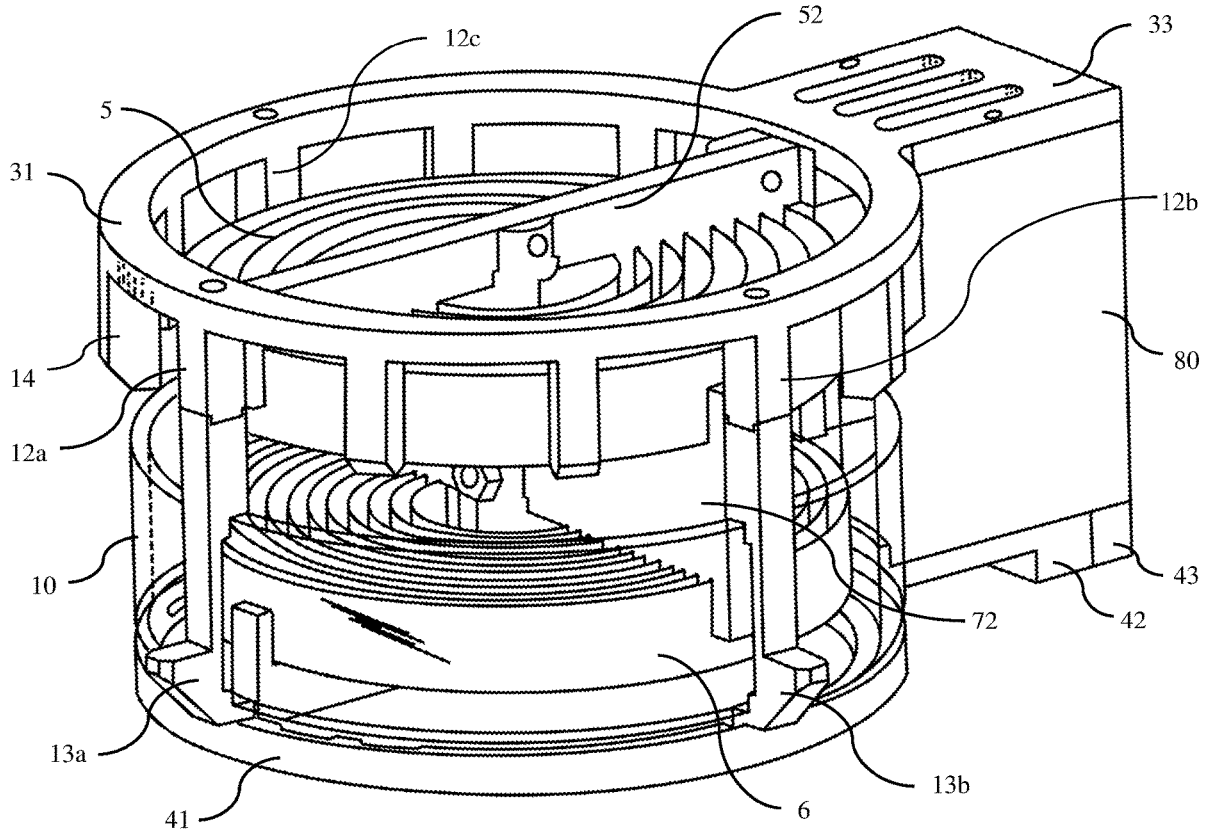
FIG. 8 is an isometric view of a third embodiment of the heating element of the invention.

Radiant heater 1 is composed of a heating element, chimney 10, upper bracket 30, middle bracket 70, lower bracket 40, electric supply housing 80, and supply system (not shown), as seen in FIG. 8. The heating element is comprised of upper heating coil 5 and lower heating coil 6. Upper heating coil 5 and lower heating coil 6 are formed of NiCr resistive wire ribbon, with a content of nickel (80%) to chromium (20%). The heating coils have a thickness of 0.0285 inches and a width of 0.1875 inches, and upper heating coil 5 has 8 windings in the single ribbon coil design, whereas lower heating coil 6 has 10 windings in the single ribbon coil design. The ratio of windings in the coil can be modified by one skilled in the art. However, upper heating coil preferably has a heat ratio to the lower heating coil of 1:2, i.e. upper heating coil generates 50% heat as the lower heating coil, thereby permitting air to flow through the chimney via a "chimney effect".

Upper heating coil 5 is oriented in radiant heater 1 on its upper edge by upper insulated mounting bracket 50, seen in FIG. 8. Upper insulated mounting bracket 50 includes upper mounting bracket support 51, which has bracket mount 52 disposed on its upper face and bracket lock 53 disposed on the body and designed to fix upper insulated bracket 55 to upper mounting bracket support 51. Bracket lock 52 is a pin or screw in the disclosed embodiment. Upper insulated bracket 55 is formed of fluorphlogopite mica-borosilicate ceramic insulation, and includes the structures disclosed in Example 2. Middle bracket interface 57 is disposed on the lower face of upper mounting bracket support 51, and dimensioned to accept middle insulated bracket 72.

Middle bracket 70 is disposed below upper heating coil 5 and provides supper for upper heating coil 5 and spacing between upper heating coil 5 and lower heating coil 6. Middle insulated mounting bracket 70 is supported by middle mounting bracket support and includes one or more middle mounting bracket supports, such as those described in Example 2. A plurality of middle insulated bracket finger 73 are disposed on the upper and lower edges of middle insulated bracket 72, as described in Example 2.

Lower insulated mounting bracket 60 acts in concert with the lower edge of middle insulated mounting bracket 70 to orient and fix lower heating coil 6. Lower mounting bracket support 61 includes the elements described in Example 2, which can include the optional elements outlined above.

Upper bracket 30 contains upper bracket ring 31 with upper bracket plate 33 disposed on a first side, as seen in FIG. 8. A plurality of upper bracket retention bars 14 extends down from the bracket ring. Additionally, a plurality of upper bracket pins 12*a*, 12*b*, 12*c* are disposed along upper bracket ring 31, and extend down from the bracket ring. Lower bracket 40 contains lower bracket ring 41 with lower bracket pins 13*a*, 13*b* (13*c*, not shown) disposed along lower bracket ring 41 and extending up from the bracket ring. Upper bracket pin 12 is adapted to fit into lower bracket pin 13. A mounting hole is disposed in upper bracket pin 12 and a portion of lower bracket pin 13 and adapted to permit a mounting pin or mounting screw to attach upper bracket pin 12 to lower bracket ring 13. Further, lower bracket pin 13 includes tab chimney spacer 45.

Lower bracket 40 includes and lower bracket plate 42, which includes an elevated arc-shaped, chimney spacer 42*a* and chimney mount 42*b* on a first side and compression face 42*c* opposite the chimney mount, as disclosed in Example 2. Compression plate 43 is dimensioned to fit on compression face 42*c* of lower bracket plate 42, and includes compression slot 44. Compression plate 43 includes plate mount face having compression slot 44 disposed on the plate mount face. First lower fitting tab 45 and second lower fitting tab 46 are disposed on lower bracket ring 41, and include first fitting tab chimney spacer 45*a* and first fitting tab chimney spacer 46*a*.

Middle mounting bracket support 71 mounts inside electric supply housing 80, as described in the above Examples.

Figure 9:
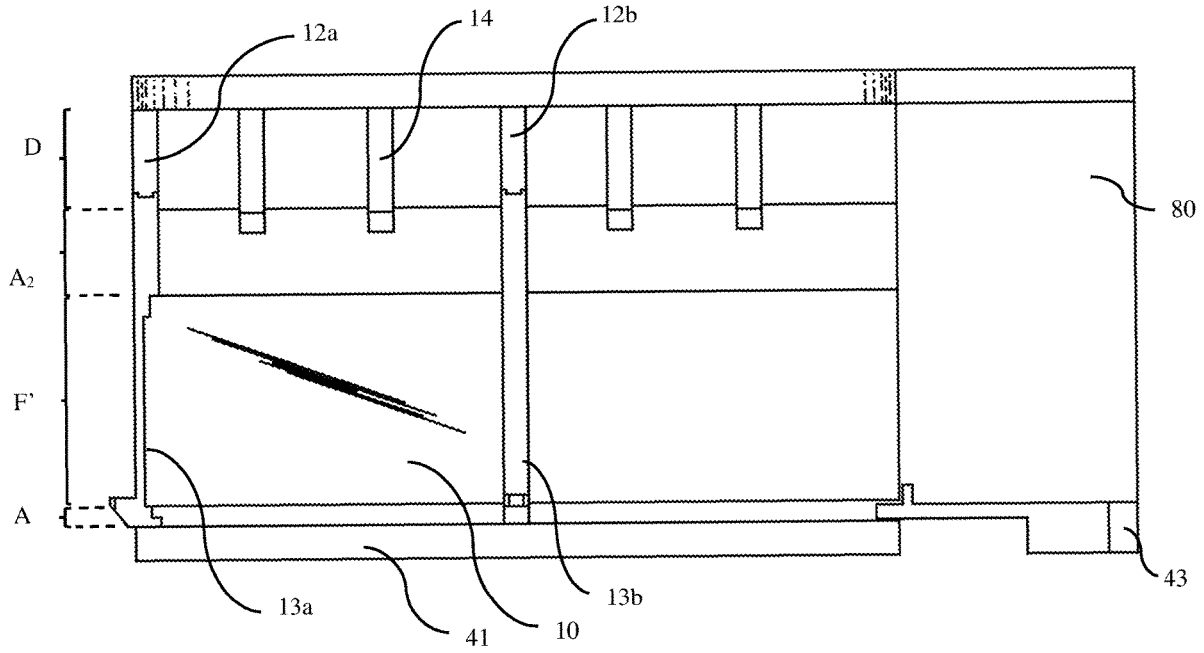
FIG. 9 is a side view of the third embodiment radiant heater of the invention.

Chimney 10 is formed on borosilicate glass or material having a similar thermal dissipation property, and includes chimney upper edge 10*a* and chimney lower edge 10*b*. Chimney lower edge 10*b* is placed onto chimney spacer 42*a*, first fitting tab chimney spacer 45*a*, and first fitting tab chimney spacer 46*a*, thereby forming a ventilation space having height A, as seen in FIG. 9. Height A is 2.5 mm. The height of chimney 10, F', and the ventilation space, $A_2$, control the flow of heated and cool air, which mix and pass through a heat shield to tobacco, vaporizing the tobacco.

Height D is defined as the thickness of upper heating coil 5. In the embodiment, height D is 9.5 mm, i.e. both coils have the same thickness.

Optionally, the radiant heater uses a piece of metal foil having holes disposed along its body.

Example 4

Figure 10:
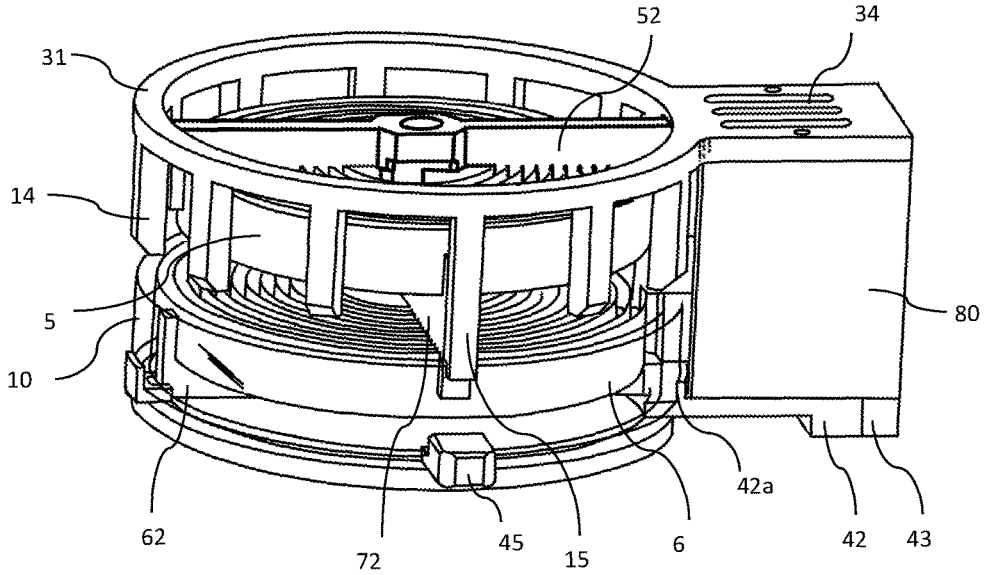
FIG. 10 is an isometric view of a fourth second embodiment of the radiant heater of the invention.

Radiant heater 1 is composed of a heating element, chimney 10, upper bracket 30, middle bracket 70, lower bracket 40, electric supply housing 80, and supply system (not shown), as seen in FIG. 10. The heating element is comprised of upper heating coil 5 and lower heating coil 6. Upper heating coil 5 and lower heating coil 6 are formed of NiCr resistive wire ribbon, with a content of nickel (80%) to chromium (20%). The heating coils have a thickness of 0.0285 inches and a width of 0.1875 inches, and upper heating coil 5 has 8 windings in the single ribbon coil design, whereas lower heating coil 6 has 10 windings in the single ribbon coil design. The ratio of windings in the coil can be modified by one skilled in the art. However, upper heating coil preferably has a heat ratio to the lower heating coil of 1:2, i.e. upper heating coil generates 50% heat as the lower heating coil, thereby permitting air to flow through the chimney via a "chimney effect".

Upper heating coil 5 is housed in radiant heater 1 within upper heating bracket 30 and circumscribed within upper bracket ring 31, upper bracket retention bars 14, and upper retention support bar 15, thereby providing a cage to prevent accidental contact with upper heating coil 5. Lower bracket 40 is similar to Example 1, but does not include ring mounts. The lower bracket includes lower bracket ring 41, chimney spacer 45, and lower bracket support structure, discussed below.

Lower heating coil 6 is disposed within chimney 10. Chimney 10 is formed on borosilicate glass or material having a similar thermal dissipation property, and includes chimney upper edge 10*a* and chimney lower edge 10*b*. Chimney lower edge 10*b* is placed onto chimney spacer 42*a*, first fitting tab chimney spacer 45*a*, and first fitting tab chimney spacer 46*a*, thereby forming a ventilation space having height A. Height A is 3 mm. The height of chimney 10 and the ventilation space control the flow of heated and cool air, which mix and pass through a heat shield to tobacco, vaporizing the tobacco. In the embodiment, chimney 10 is the same height as lower heating coil 6 and Height G, seen in FIG. 7, i.e. is equivalent to the distance of Height F and Height G.

Upper insulated mounting bracket 50 includes upper insulated bracket 52, formed of fluorphlogopite mica-borosilicate ceramic insulation (Macor, Corning Inc., Corning, N.Y.), and includes a plurality of upper insulated bracket fingers 56 on the lower edge of the insulated bracket, and spaced to ensure the windings of upper heating coil 5 remain at the predetermined spacing.

Middle bracket 70 is disposed below upper heating coil 5 and provides support for upper heating coil 5 and spacing between upper heating coil 5 and lower heating coil 6. Middle insulated mounting bracket 70 is formed of middle insulated bracket 72. The middle bracket is supported by support 87. Middle insulated bracket 72 is made of insulated composite, such as that described for upper insulated bracket 52. A plurality of middle insulated bracket fingers 73 are disposed on the upper and lower edges of middle insulated bracket 72, where the upper edge fingers support upper heating coil 5 and the lower edge fingers support lower heating coil 6.

Figure 11:
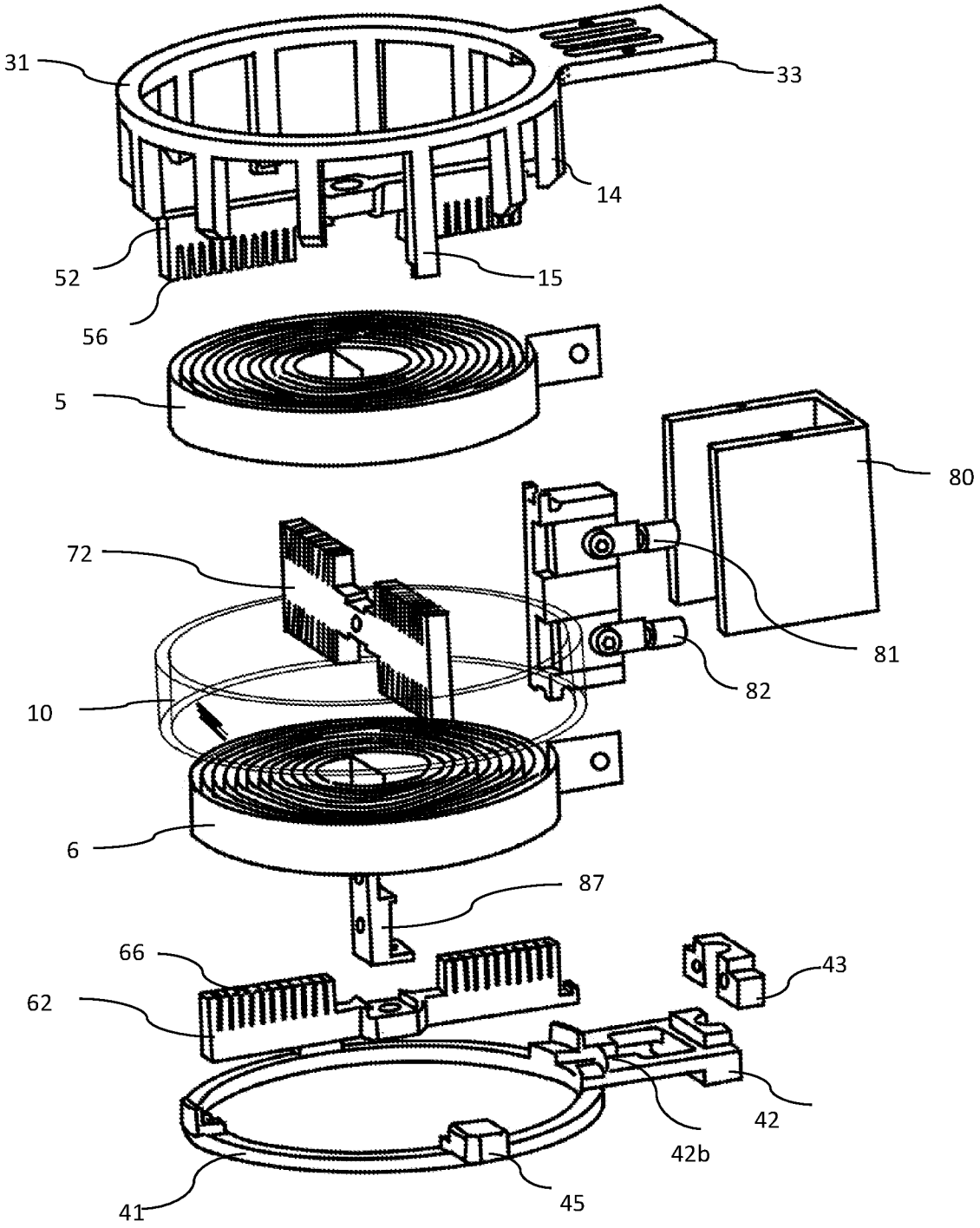
FIG. 11 is an isometric, breakaway view of a fourth second embodiment of the radiant heater of the invention

Lower insulated mounting bracket 60 acts in concert with the lower edge of middle insulated mounting bracket 70 to orient and fix lower heating coil 6. Lower mounting bracket support 61 includes lower insulated bracket 62. In some embodiments, lower mounting bracket support 61 has lower middle bracket interface 57*b* designed to interact with support 87. Lower insulated bracket 62 is formed of an insulation similar or the same to upper insulated bracket 52. The upper edge of lower insulated bracket 62 ends in lower insulated bracket finger 66, dimensioned to accept the coils of lower heating coil 6, as seen in FIG. 11.

Upper bracket 30 is supported by upper bracket plate 33 disposed on one edge of the upper bracket body, as seen in FIG. 10. A plurality of upper bracket vents 34 are disposed on upper bracket plate 33. Lower bracket 40 has lower bracket ring 41 with lower bracket plate 42. Lower bracket plate 42 includes an elevated arc-shaped chimney spacer 42*a* and chimney mount 42*b* on a first side and compression face 42*c* opposite the chimney mount. Compression plate 43 is dimensioned to fit on compression face 42*c* of lower bracket plate 42, and includes compression slot 44. Compression plate 43 includes plate mount face having compression slot 44 disposed on the plate mount face. First lower fitting tab 45 and second lower fitting tab 46 are disposed on lower bracket ring 41, and include first fitting tab chimney spacer 45*a* and first fitting tab chimney spacer 46*a*.

Electric supply housing 80 is similar to earlier examples and includes upper heating coil bracket 82, dimensioned to accept upper heating coil connector 8, and lower heating coil bracket 85, dimensioned to accept lower heating coil connector 9. Upper heating coil bracket 82 attaches to upper heating coil electric connector 81 through upper heating coil lock 83, depicted in FIG. 5. Similarly, lower heating coil bracket 85 attaches to lower heating coil electric connector 84 through lower heating coil lock 86.

In this embodiment, the radiant heater is assembled and placed directly onto the tobacco head of a hookah, without a heat shield, heating plate, or any other material between lower heating coil 6 and the tobacco.

Example 5

Radiant heater 1 is composed of a heating element, chimney 10, upper bracket 30, middle bracket 70, lower bracket 40, electric supply housing 80, and supply system, described in Example 4. The radiant heater is assembled as described above. A user places a piece of metal foil or a piece of metal foil having holes disposed along its body over the tobacco and places radiant heater 1 over the foil. The heater is secured to the hookah and heated, providing heat that dissipates through the metal foil to the tobacco.

EXAMPLE

Figure 12:
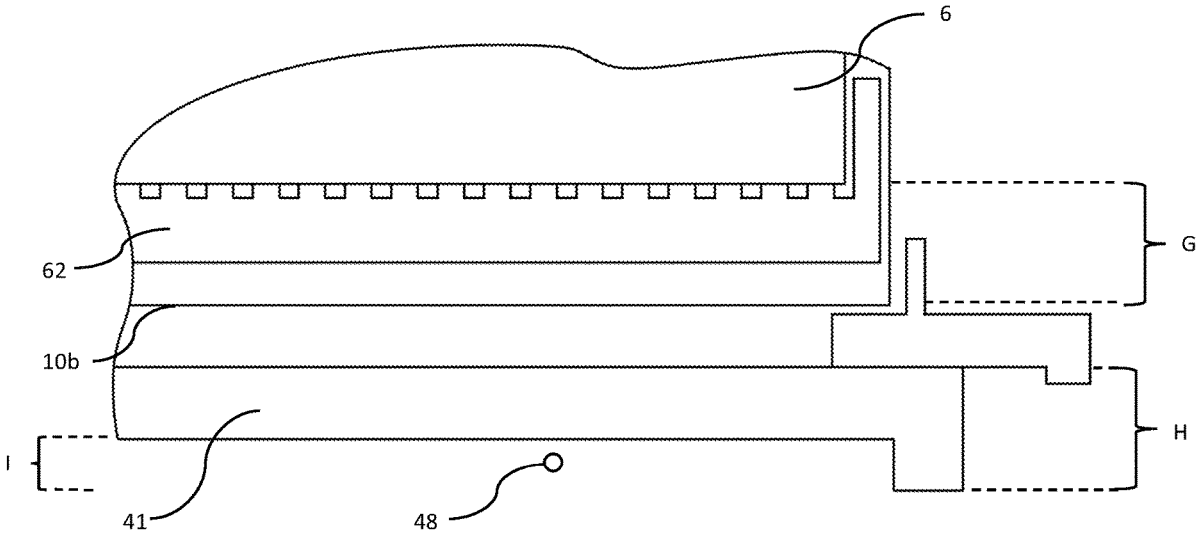
FIG. 12 is a cut away side view of the radiant heater of the invention showing a first embodiment to attach a heating plate.

A heating plate is placed into heating plate indent 48 on the lower face of lower bracket 40, depicted in FIG. 12. Lower bracket 40 is thickness H, which in this variation is 3.5 mm. Heating plate indent 48 is height I, which is 1.5 mm. Preferably, heating plate body 21 has the same or about the same thickness as height I, allowing heating plate 20 to fit against lower bracket 40, forming a flush face for the hookah.

Example 6

Figure 13:
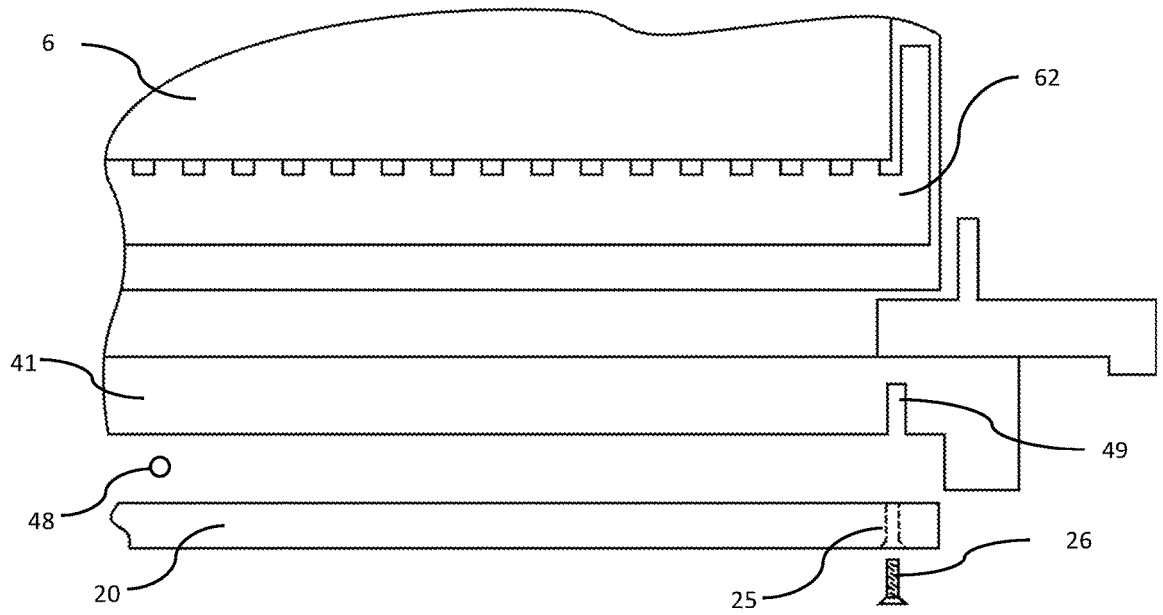
FIG. 13 is a cut away side view of the radiant heater of the invention showing a second embodiment to attach a heating plate.

Heating plate mounting hole 25 is disposed in heating plate body 21, and dimensioned to accept heating plate mounting post 26, seen in FIG. 13. Ring mounting hole 49 is disposed in lower bracket 40, along heating plate indent 48, as seen in FIG. 13. Ring mounting hole 49 corresponds to heating plate mounting hole 25, and dimensioned to accept heating plate mounting post 26, such that heating plate mounting post 26 is capable of entering ring mounting hole 49 and heating plate mounting hole 25 to mount heating plate 20 to lower bracket 40.

Heating plate 20 is placed into heating plate indent 48 on the lower face of lower bracket 40, depicted in FIG. 13. Lower bracket 40 is thickness H, which in this variation is 3.5 mm. Heating plate indent 48 is height I, which is 1.5 mm. Preferably, heating plate body 21 has the same or about the same thickness as height I, allowing heating plate 20 to fit against lower bracket 40, forming a flush face for the hookah. Heating plate mounting hole 25 is aligned with ring mounting hole 49 and heating plate mounting post 26 placed in the holes to mount heating plate 20 to lower bracket 40.

Example 7

Figure 14:
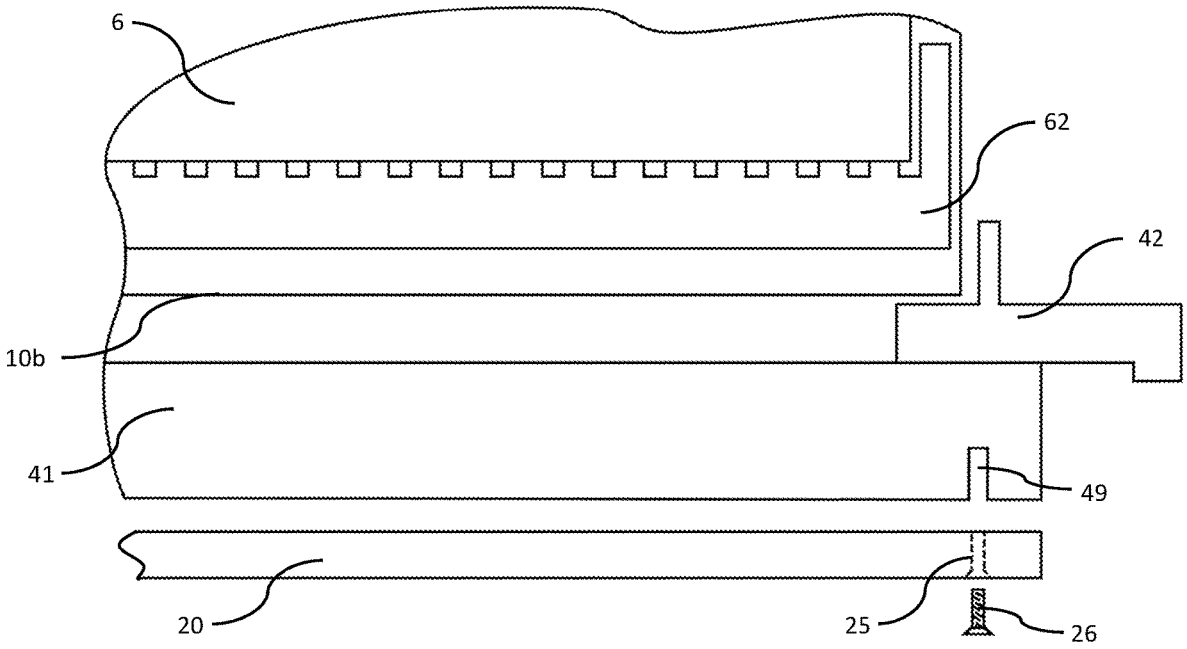
FIG. 14 is a cut away side view of the radiant heater of the invention showing a third embodiment to attach a heating plate.

Heating plate mounting hole 25 is disposed in heating plate body 21, and dimensioned to accept heating plate mounting post 26, seen in FIG. 14. Ring mounting hole 49 is disposed in lower bracket 40. Ring mounting hole 49 corresponds to heating plate mounting hole 25, and dimensioned to accept heating plate mounting post 26, such that heating plate mounting post 26 is capable of entering ring mounting hole 49 and heating plate mounting hole 25 to mount heating plate 20 to lower bracket 40.

Heating plate 20 is placed against the lower face of lower bracket 40, depicted in FIG. 14. Heating plate body 21 has the same circumference as lower bracket 40 in this embodiment. Heating plate mounting hole 25 is aligned with ring mounting hole 49 and heating plate mounting post 26 placed in the holes to mount heating plate 20 to lower bracket 40.

Example 8

Upper heating coil 5 is formed of NiCr resistive wire ribbon, with a content of nickel (80%) to chromium (20%). The heating coil has a thickness of 0.0285 inches and a width of 0.1875 inches. Upper heating coil 5 has 8 windings in the single ribbon coil design, shown in FIG. 15. The outermost coil terminates in upper heating coil connector 8, a straight section of resistive wire ribbon. Upper heating coil connector 8 is dimensioned to reach upper heating coil bracket 82 in bracket support 71, and fits in the bracket. Upper heating coil electric connector 81 is in electrical communication with upper heating coil connector 8, and fixed together by upper heating coil lock 83, depicted in FIG. 5.

Lower heating coil 6 has a similar structure to upper heating coil 5, formed of 10 windings in the coil, and terminating in lower heating coil connector 9, a straight section of resistive wire ribbon. Lower heating coil connector 9 is dimensioned to reach lower heating coil bracket 85 in bracket support 71, and fits in the bracket. Lower heating coil electric connector 84 is in electrical communication with lower heating coil connector 9. Lower heating coil lock 86 fixes lower heating coil electric connector 84 to lower heating coil connector 9.

Example 9

Heating element 3 began with resistance cable 80. Numerous designs were prepared, including a coil, similar to those with resistance ribbon seen in FIG. 15. During testing, the resistance cable was found to lack sufficient energy to maintain temperature. As air was drawn past the heating element, the air cooled the resistance cable such that the resistance cable dropped below temperatures required to vaporize the tobacco. To compensate for the drop in temperature, the resistance cable was heated to higher temperatures, which resulted in the tobacco burning. Because the distance of the resistance wire dictates impedance, resistance cable 80 was formed into corrugated coils. This design also permitted increases in cable thickness. While this improved the thermal retention of the resistance cable, the design still lost too much heat to adequately heat the tobacco without burning. Addition designs utilizing the resistance cable did not improve on the thermal retention and transfer properties. As such, it was deemed that resistance cable was insufficient for use in heating tobacco.

Example 9

Heating element designs included a double back ribbon coil, as seen in FIG. 16. Resistance ribbon was coiled into a spiral to a center, to form upper heating coil 5. In this embodiment, the reverse coil results in the coil coiling back upon itself. This results in the two ends of the resistance ribbon extending from the coil, forming upper heating coil input connector 8*a* and upper heating coil output connector 8*b*. The designs were formed to generate a temperature range of about 600° F. to about 1000° F. with between about 18 and about 22 Amps. Furthermore, the ribbon must retain sufficient energy such that an airstream resulting from use of a hookah does not result in the heating element dropping below 600° F. Accordingly, the resistance ribbon used has a thickness and width of 0.0285 inches×0.1875 inches (0.72 mm×4.7 mm).

Example 10

Figure 17:
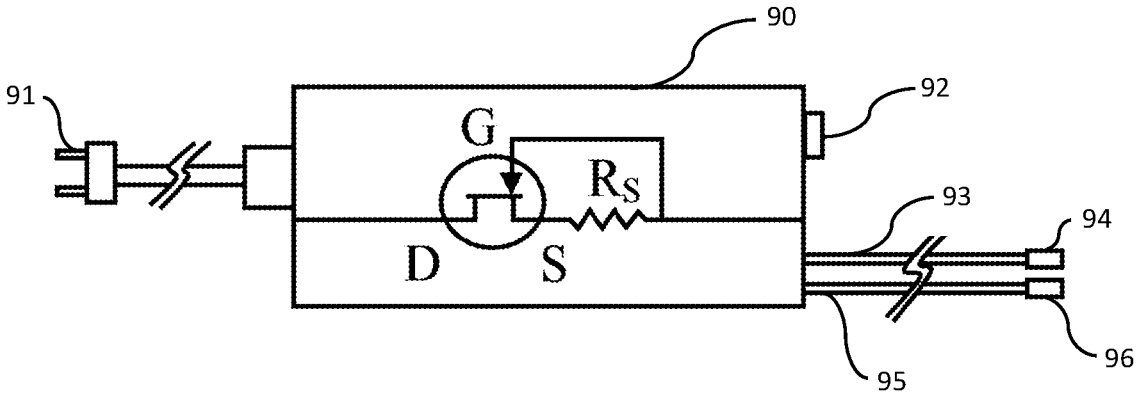
FIG. 17 is a power supply of the invention.

Power supply 90 is a dual output current regulated system that is dimmable, as seen in FIG. 17. Power supply 90 includes power supply input 91, such as a standard power plug capable of accepting 100-277 $V_{AC}$. Current adjustment 92 is disposed on power supply 90 and can alter current between 0 and 100 kΩ in a first channel and between 0 and 100 kΩ in a second channel, resulting in a power current of 10.5 Amps to 13.5 Amps for the first channel (maximum of 23V) and 5 Amps and 8 Amps for the second channel (maximum of 11V). Upper heating coil output 93 is in electrical communication with the second channel and exits power supply 90 and includes +11V in pin 1 and 0V in pin 2. Upper heating coil output 93 terminates in upper heating coil output connector 94, which connects to upper heating coil electric connector 81. Lower heating coil output 95 is in electrical communication with the first channel and exits power supply 90 and includes +23V in pin 1 and 0V in pin 2. Lower heating coil output 95 terminates in lower heating coil output connector 96, which connects to lower heating coil electric connector 84.

Example 11

Figure 18:
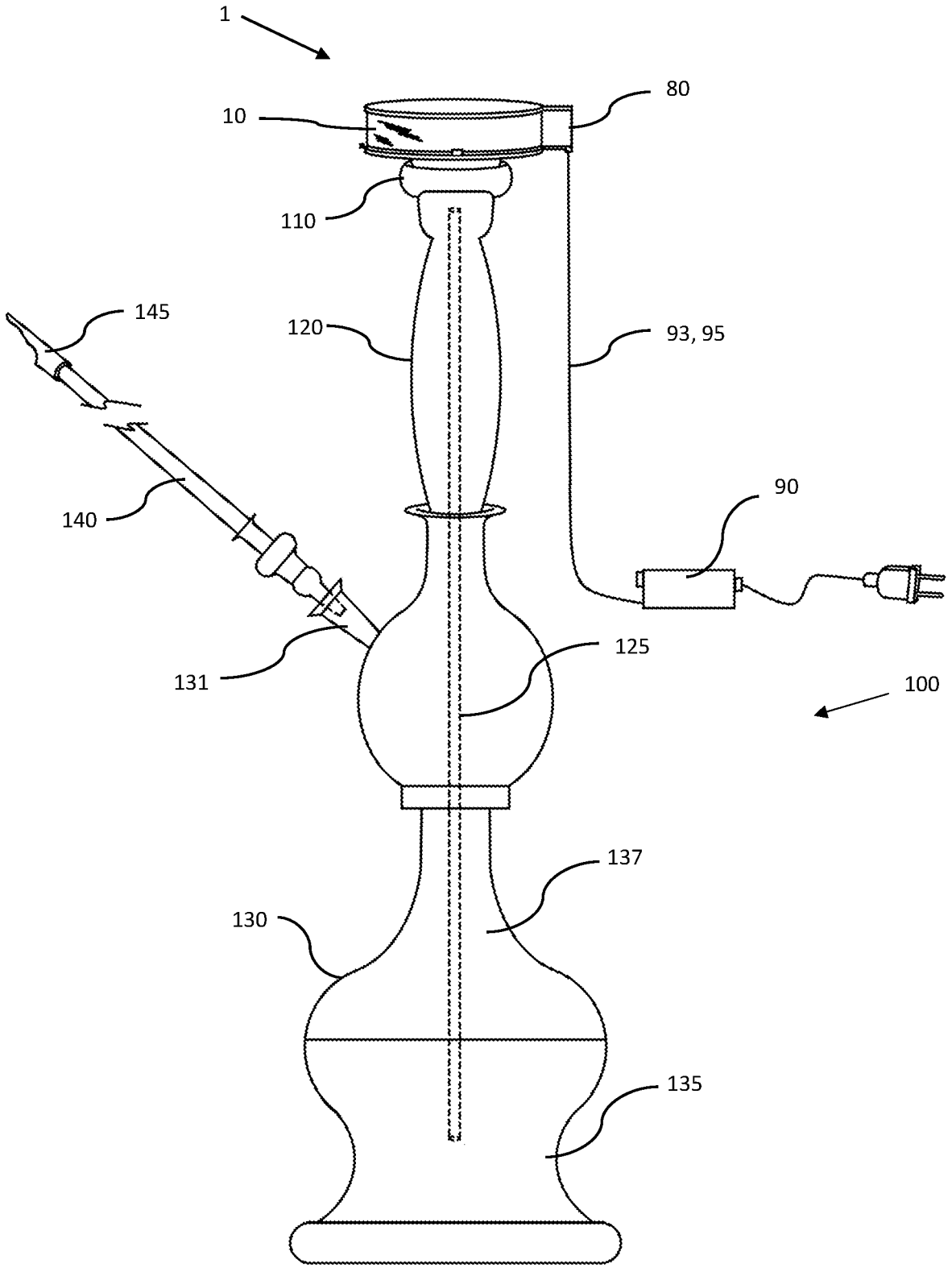
FIG. 18 is a cut away view of a hookah with an embodiment of the invention attached to the head.

Hookah 100 is prepared for use as commonly known in the art, with vase 130 comprising water 135 with head space 137 immediately above water 135, seen in FIG. 18. Hose 140 connects to vase 130 at port 131 via a first end and thereby directly accesses dead space 137. Mouthpiece 145 connects to a second end of hose 140. Body 120 is mounted onto vase 130, such that channel 125, located in the interior of body 120 is positioned to enable the lower end of the channel to submerge in water 135. The lower portion of body 120 forms a seal with an upper opening in vase 130. Head 110 is mounted to the upper portion of body 120 and in fluid communication with channel 125. Head 110 is made of a material capable of withstanding temperatures needed to vaporize the combustible material, such as glass, ceramic, or steel. Tobacco or other combustible material is placed in head 110.

Radiant heater 1 is assembled as described in previous Examples, and placed on top of head 110. One or more silicon rubber bands 115 are attached to first lower fitting tab 45 and second lower fitting tab 46, such that the rubber bands traverse the lower flair of head 110, as seen in FIG. 15, thereby securing heat transfer plate 20 to head 110. The upper edge of radiant heater 1 is not covered, allowing heat to escape. Testing showed that covering the upper surface of the heating element resulted in overly high temperatures that burned the combustible material, as noted above.

The distance of upper heating coil 5 and lower heating coil 6 to heat transfer plate 10 is adjusted using height adjustment tab 32. The radiant heater is connected to an electrical source providing about 10-24V and a current of about 5 to 15 Amperes and the heater elements warmed up. Electrical current causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation space between the chimney and heat transfer plate, and mixes with the heated air. The mixed air is drawn through the plurality of vents and into the tobacco, heating the glycerin and aromatic oils in the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

Example 12

Figure 19:
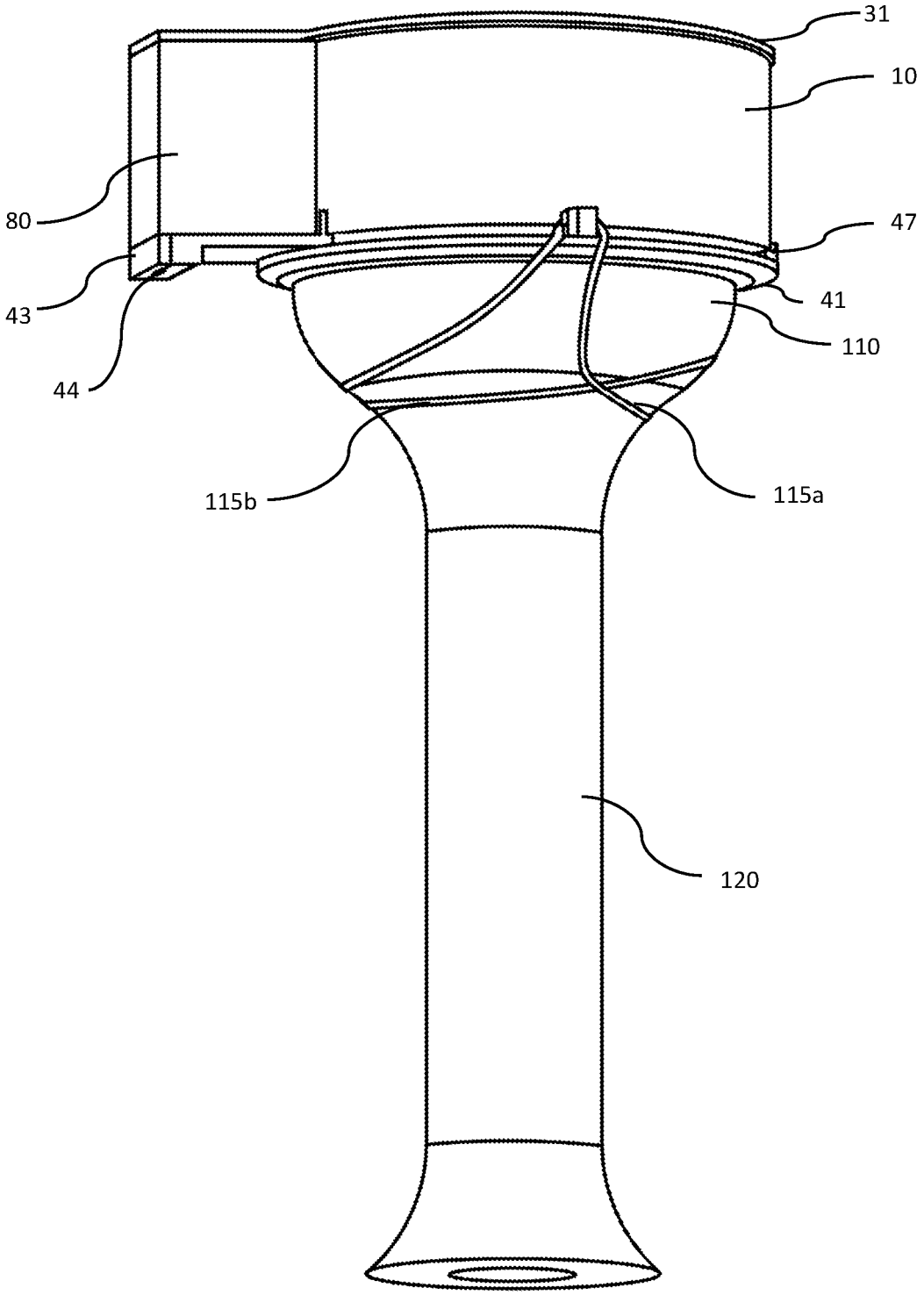
FIG. 19 is an isometric view of the inventive heater attached to a hookah head using silicon rubber bands

Hookah 100 is prepared as described in Example 11, and tobacco or other combustible material is placed in head 110. Heat transfer plate 20 is placed onto the upper edge of head 110. A heat transfer shield is placed onto the upper edge of head 110. In some embodiments, the heat transfer shield is a section of metal foil having holes, or is a heating plate as discussed in previous Examples. Radiant heater 1 was assembled as described in Example 1. Radiant heater 1 is placed on head 110, One or more silicon rubber bands, also known as cooking rubber bands, are attached to first lower fitting tab 45 and second lower fitting tab 46, such that the rubber bands traverse the lower flair of head 110, as seen in FIG. 19, thereby securing heat transfer plate 20 to head 110. The upper edge of radiant heater 1 is not covered, allowing heat to escape. Testing showed that covering the upper surface of the heating element resulted in overly high temperatures that burned the combustible material, as noted above.

The radiant heater is connected to an electrical source providing about 10V to about 25 V and a current of about 4 Amperes to about 25 Amperes and the heater elements warmed up. Electrical current is then applied, causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation space between the chimney and heat transfer plate, and mixes with the heated air. In this embodiment, the ventilation space is at a fixed distance. The distance of the ventilation space and the distance the chimney extends beyond the heating elements provides a self-modulating design. When not in use, air is siphoned through the upper edge of the chimney, transferring the heat away from the tobacco. When used, the mixed air is drawn through the plurality of vents and into the tobacco, heating the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

Example 13

Hookah 100 is prepared as described in Example 12, and tobacco or other combustible material is placed in head 110. A heat transfer shield is placed onto the upper edge of head 110. In some embodiments, the heat transfer shield is a section of metal foil having holes, or is a heating plate as discussed in previous Examples. Radiant heater 1 was assembled as described in Example 2. Radiant heater 1 is placed on head 110, and one or more silicon rubber bands, also known as cooking rubber bands, are attached to first lower fitting tab 45 and second lower fitting tab 46, such that the rubber bands traverse the lower flair of head 110, as seen in FIG. 19, thereby securing radiant heater 1 to head 110. The upper edge of radiant heater 1 is not covered, allowing heat to escape. Testing showed that covering the upper surface of the heating element resulted in overly high temperatures that burned the combustible material, as noted above.

The radiant heater is connected to an electrical source providing about 10V to about 25 V and a current of about 4 Amperes to about 25 Amperes and the heater elements warmed up. Electrical current is then applied, causing upper heating coil 5 and lower heating coil 6 to generate heat pursuant to Joule's first law. A user draws air through mouthpiece 145, resulting in a vacuum in the head space of the vase. The vacuum draws air from the head. At the head, air travels past heater elements, warming the air. Cooler air is drawn into the area below the heater elements via the ventilation space between the chimney and heat transfer plate, and mixes with the heated air. In this embodiment, the ventilation space is at a fixed distance. The distance of the ventilation space and the distance the chimney extends beyond the heating elements provides a self-modulating design. When not in use, air is siphoned through the upper edge of the chimney, transferring the heat away from the tobacco. When used, the mixed air is drawn through the plurality of vents and into the tobacco, heating the tobacco to vaporization. The airflow draws the vapor smoke into the body channel, whereupon the vapor smoke is pulled into water in the vase, forming smoke vapor bubbles in the water that filter the raw smoke vapor. The smoke vapor then enters a head space in the vase, where it is drawn to the user.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosure of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall therebetween.

What is claimed is:

1. A radiant heating system, comprising:

a heating element, wherein the heating element comprises:

at least one heating coil comprising resistance wire;

a chimney having an interior space defined by at least one wall and dimensioned to accept the at least one heating element within the interior space;

wherein the chimney circumscribes a portion of the heating element;

wherein at least the upper edge of the heating element or an upper-most heating element is not circumscribed by the chimney; and at least one spacer disposed along the lower edge of the chimney, wherein the at least one spacer defines a ventilation space beneath the lower edge of the chimney.

2. The radiant heating system of claim 1, further comprising a shield disposed below the at least one spacer.

3. The radiant heating system of claim 2, wherein the shield is metal foil, a metal plate, or metal plate having a plurality of holes.

4. The radiant heating system of claim 1, wherein 50% or less of the heating element is circumscribed by the chimney.

5. The radiant heating system of claim 1, further comprising:

an upper mounting bracket dimensioned to circumscribe the upper edge of the heating element, wherein the upper mounting bracket further comprises:

at least a first upper mount disposed on a first side of the upper mounting bracket;

a second upper mount disposed on a second side of the upper mounting bracket;

a lower mounting bracket, further comprising:

a body disposed on the at least one spacer, wherein the at least one spacer is disposed on the upper edge of the lower mounting bracket; and at least a second spacer is disposed on the upper edge of the body of the lower mounting bracket;

wherein the second spacer is disposed opposite the lower at least one spacer.

6. The radiant heating system of claim 5, wherein the second upper mount is a bracket plate having a body formed of a horizontal plate and at least one vent disposed on the body of the bracket plate; and wherein the lower mounting bracket further comprises a second lower mount wherein the second lower mount comprises a body that extends distally from the lower mounting bracket and terminates in a compression end;

a compression plate dimensioned to fit on the compression end of the lower mount, and comprises:

a compression face; and a compression slot disposed on the compression face.

7. The radiant heating system of claim 1, further comprising:

an upper insulated mount, further comprising:

an upper mount support, comprising:

a lower end and an upper end;

an upper opening disposed on the upper mount support;

an upper insulated bracket having an upper edge and a lower edge, and dimensioned to fit into the upper opening of the upper mount support;

at least one insulated bracket finger disposed on the lower edge of the upper insulated bracket;

a lower insulated mount, further comprising:

a lower mount support, comprising:

a lower end and an upper end;

a lower opening disposed on the lower mount support;

a lower insulated bracket having an upper edge and a lower edge, and dimensioned to fit into the lower opening; and at least one insulated bracket finger disposed on the upper edge of the lower insulated bracket.

8. The radiant heating system of claim 7, further comprising:

at least an upper heating coil opening disposed on the body of the upper mount support and dimensioned to accept an upper heating coil.

9. The radiant heating system of claim 1, wherein the heating element comprises a plurality of heating coils, where the plurality of heating coils comprise:

an upper heating coil comprising a resistive ribbon having a first end and a second end where the first end of the upper heating coil is circumscribed by the upper heating coil and the second end of the upper heating coil extends from a coil in the upper heating coil to form an upper heating coil connector;

a lower heating coil comprising a resistive ribbon having a first end and a second end where the first end of the lower heating coil is circumscribed by the lower heating coil and the second end of the lower heating coil extends from a coil in the lower heating coil to form a lower heating coil connector;

an upper heating coil electric connector in electrical communication with the upper heating coil connector; where the upper heating coil connector is an electrically conductive material;

a lower heating coil electric connector in electrical communication with the lower heating coil connector; and where the lower heating coil connector is an electrically conductive material.

10. The radiant heating system of claim 8, further comprising a middle-insulated mount comprising:

a middle-insulated bracket comprising:

a body having an upper edge and a lower edge;

at least one insulated bracket finger disposed on the upper edge of the middle-insulated bracket; and at least one insulated bracket finger disposed on the lower edge of the middle-insulated bracket.

11. The radiant heating system of claim 10, wherein the middle-insulated mount further comprises a middle mount support, wherein the middle mount support further comprises:

a support body having a at least one mount support bar opening disposed along the body;

an upper heating coil bracket disposed on the support body above the at least one mount support bar opening, dimensioned to accept a second end of the upper heating coil;

wherein the upper heating coil electric connector is disposed adjacent to the upper heating coil bracket;

a lower heating coil bracket disposed on the support body below the at least one mount support bar opening, dimensioned to accept a second end of a lower heating coil; and wherein the lower heating coil electric connector is disposed adjacent to the lower heating coil bracket.

12. The radiant heating system of claim 5, wherein the lower mounting bracket further comprises a third spacer disposed on an upper face of the body of the lower mounting bracket, and dimensioned to provide the ventilation space disposed between the lower edge of the chimney and the upper edge of the lower mounting bracket; and a fourth spacer disposed on an upper face of the body of the lower mounting bracket, and dimensioned to provide the ventilation space disposed between the lower edge of the chimney and the upper edge of the lower mounting bracket.

13. The radiant heating system of claim 1, further comprising a current-regulated electrical source in an electrical communication with the at least one heating coil.

14. The radiant heating system of claim 12, wherein the electric source is current adjustable, wherein the current is adjustable from 5 amps to 25 amps.

15. The radiant heating system of claim 1, wherein the ventilation space is about 1 mm to about 10 mm.

16. The radiant heating system of claim 1, wherein the chimney has a circular cross section, triangular cross section, square cross section, pentagonal cross section, hexagonal cross section, heptagonal cross section, octagonal cross section, or nonagonal cross section.

17. The radiant heating system of claim 1, wherein the heating coil is a single ribbon coil, a double-back ribbon coil, or a center spiral two layer ribbon coil.

18. The radiant heating system of claim 5, wherein the upper mounting bracket further comprises a plurality of upper bracket retention bars, wherein the upper bracket retention bars are disposed on the lower face of the upper mounting bracket;

and wherein the chimney extends partially between the upper mounting bracket and the lower mounting bracket.

19. The radiant heating system of claim 3, wherein the shield is a metal plate having a plurality of holes; wherein the plurality of holes are disposed in at least one circular configuration on the metal plate.

20. The radiant heating system of claim 5, wherein the lower mounting bracket, further comprising a heating plate indent disposed on the lower face of the lower mounting bracket body; and a shield disposed below the lower mounting bracket and dimensioned to correspond to the heating plate indent.

* * * * *